US007922070B2

(12) United States Patent
Auclair

(10) Patent No.: US 7,922,070 B2
(45) Date of Patent: Apr. 12, 2011

(54) CARTON WITH CARRYING HANDLE AND BLANK THEREFOR

(75) Inventor: Jean-Michel Auclair, Châteauroux (FR)

(73) Assignee: Meadwestvaco Packaging Systems, LLC, Richmond, VA (US)

( * ) Notice: Subject to any disclaimer, the term of this patent is extended or adjusted under 35 U.S.C. 154(b) by 499 days.

(21) Appl. No.: 11/815,011

(22) PCT Filed: Jan. 27, 2006

(86) PCT No.: PCT/US2006/003199
§ 371 (c)(1),
(2), (4) Date: May 19, 2008

(87) PCT Pub. No.: WO2006/081548
PCT Pub. Date: Aug. 3, 2006

(65) Prior Publication Data

US 2008/0245679 A1 Oct. 9, 2008

(30) Foreign Application Priority Data

Jan. 28, 2005 (GB) ..... 0501634.0

(51) Int. Cl.
*B65D 75/00* (2006.01)
*B65D 5/00* (2006.01)
*B65D 5/46* (2006.01)

(52) U.S. Cl. ..... 229/117.12; 229/103.2; 206/147; 206/427

(58) Field of Classification Search ..... 229/117.12, 229/103.2, 934, 200; 206/147, 430, 155
See application file for complete search history.

(56) References Cited

U.S. PATENT DOCUMENTS

| | | | | |
|---|---|---|---|---|
| 2,628,764 | A | 2/1953 | Rubinstein | |
| 3,197,116 | A | 7/1965 | Zastrow | |
| 4,343,428 | A | 8/1982 | Persson | |
| 4,482,090 | A | 11/1984 | Milliens | |
| 4,785,991 | A | 11/1988 | Schuster | |
| 5,328,081 | A | 7/1994 | Saulas | |
| 5,566,878 | A | 10/1996 | Peiffer et al. | |
| 5,699,957 | A * | 12/1997 | Blin et al. | 229/117.12 |
| 5,853,088 | A * | 12/1998 | Saulas et al. | 206/427 |
| 6,250,542 | B1 * | 6/2001 | Negelen | 229/117.16 |
| 6,631,803 | B2 * | 10/2003 | Rhodes et al. | 206/427 |
| 6,708,874 | B1 * | 3/2004 | Montgomery | 229/117.16 |
| 2003/0111523 | A1 | 6/2003 | Haugan | |

FOREIGN PATENT DOCUMENTS

| | | | |
|---|---|---|---|
| DE | 34 34870 | C1 | 1/1986 |
| GB | 1103372 | A | 2/1968 |
| GB | 1602857 | A | 11/1981 |

* cited by examiner

*Primary Examiner* — Nathan J Newhouse
*Assistant Examiner* — Christopher Demeree
(74) *Attorney, Agent, or Firm* — MWV Intellectual Property Group

(57) ABSTRACT

A carton (130) for packaging cylindrical articles, the carton (130) including a plurality of primary panels (120, 122, 124, 125) for forming the walls of the carton (130), end flaps (118*a*, 118*b*, 126*a*, 126*b*, 128*a*, 128*b*, 119*a*, 119*b*) for forming end closure structures (132, 134) of the carton (130), and handle panels (160, 162) and handle end flaps (182*a*, 182*b*, 183*a*, 183*b*) for forming a handle structure (160/162). The handle structure (160/162) and a panel (125) define a pocket that can be engaged by a user's hand (H1) to carry the carton (130). The carton (130) further including features that facilitate flexing of the handle structure (160/162) including fold lines (178) and cut lines (C2, C3).

19 Claims, 21 Drawing Sheets

CARTON WITH CARRYING HANDLE AND BLANK THEREFOR

TECHNICAL BACKGROUND

The present invention relates to cartons for containing a multiplicity of articles, and in particular, to a pocket carrying handle provided on the carton.

BACKGROUND

In the beverage industry it is widely known to provide cartons with carrying handles to facilitate the portability of heavy cartons containing multiple cans or bottles. It is also often desirable for handles to be provided to encourage the return of bottles or cans to a recycling point.

Carrying handles need to be strong and durable to support the weight of such cartons, which can be considerable. It is also desirable for such handles to be easy to grasp and readily accessible. Additionally, it is required to provide carrying handles which are comfortable for customers to use, and which shield the user's hands from the goods contained within the carton. This can be a particularly useful feature when the cartons contain goods such as bottles with crown caps. The sharp edges of the crown corks can graze a user's hands if insertion of the hand inside the carton is required to employ a handle and no shielding is provided.

A further requirement of cartons used to supply multiple articles is a large printable surface area. Often, carrying handles can interrupt the printable area, which is often used for displaying branding and advertising. It is therefore desirable to have a carrying handle which does not interrupt or distort the printable surface.

Furthermore, it is often desirable to have cartons which are easy to construct, which include handles which are integrally formed with the carton, which require a minimum amount of adhesive to secure the carton together, and which combine strength and durability with a minimum usage of material. Cartons having carrying handles are known in the art. In U.S. Pat. No. 5,328,081, Saulas discloses a strap handle which is formed across the top panel of a carton. The strap handle is deployed by lifting a central portion above the plane of the top wall. The flexing of the handle is facilitated by the inward displacement of end portions of the strap handle. Such handles can have weak points at the handle ends which, if used with heavy cartons, can cause the handle to fail. Furthermore, such handles are cut out of a primary panel of the carton. Thus, the printable surface area is distorted and the contents of the carton are exposed. Additionally, the inward displacement of the handle ends requires space within the carton, which is not always available in cartons that are tightly packed. This is often the case with cartons that are loaded with cans. Also, such handles can often be uncomfortable to use. For example, the edges of the strap of the handle can cut into the palm of a user's hand.

Another carrying handle is disclosed by Milliens in U.S. Pat. No. 4,482,090. The carrying handle is provided by two slots formed in the top wall. The top wall is reinforced by folding an additional panel into an overlapping relationship with the top wall. Use of the handle requires a user to insert his or her hand into the slots formed. The handle can therefore be uncomfortable to use, and indeed difficult to employ, since there is no flexibility to lift the handle above the top wall. A further disadvantage of the handle is that the contents of the carton are exposed through the slot handles. The slots also interrupt the printable area.

The present invention seeks to avoid, or at least mitigate, these and other problems of the prior art. The present invention provides carrying handles, formed integrally with the carton, which are strong and comfortable to use. In addition, the carrying handles can be constructed with a minimum amount of glue or adhesive.

SUMMARY

The various embodiments of the present invention overcome the shortcomings of the prior art by providing a carton for packaging cylindrical containers. The carton includes a plurality of panels that form the walls of the carton and at least one handle structure. The handle structure includes a handle panel that is disposed in an overlapping relationship over a first panel of the carton. The handle panel includes transverse edges and end portions. One of the transverse edges is connected to one of the panels of the carton and the other is a transverse carrying edge that is engaged by a user. Each of the end portions of the handle panel are secured to respective panels of the carton. A pocket is formed between the handle structure and the first panel of the carton. The pocket can be engaged to carry the carton through an opening that is adjacent to the transverse carrying edge of the handle panel.

Other systems, methods, features, and advantages of the present invention will be or become apparent to one with skill in the art upon examination of the following drawings and detailed description. All such additional systems, methods, features, and advantages are included within the scope of the present teaching and are protected by the accompanying claims.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
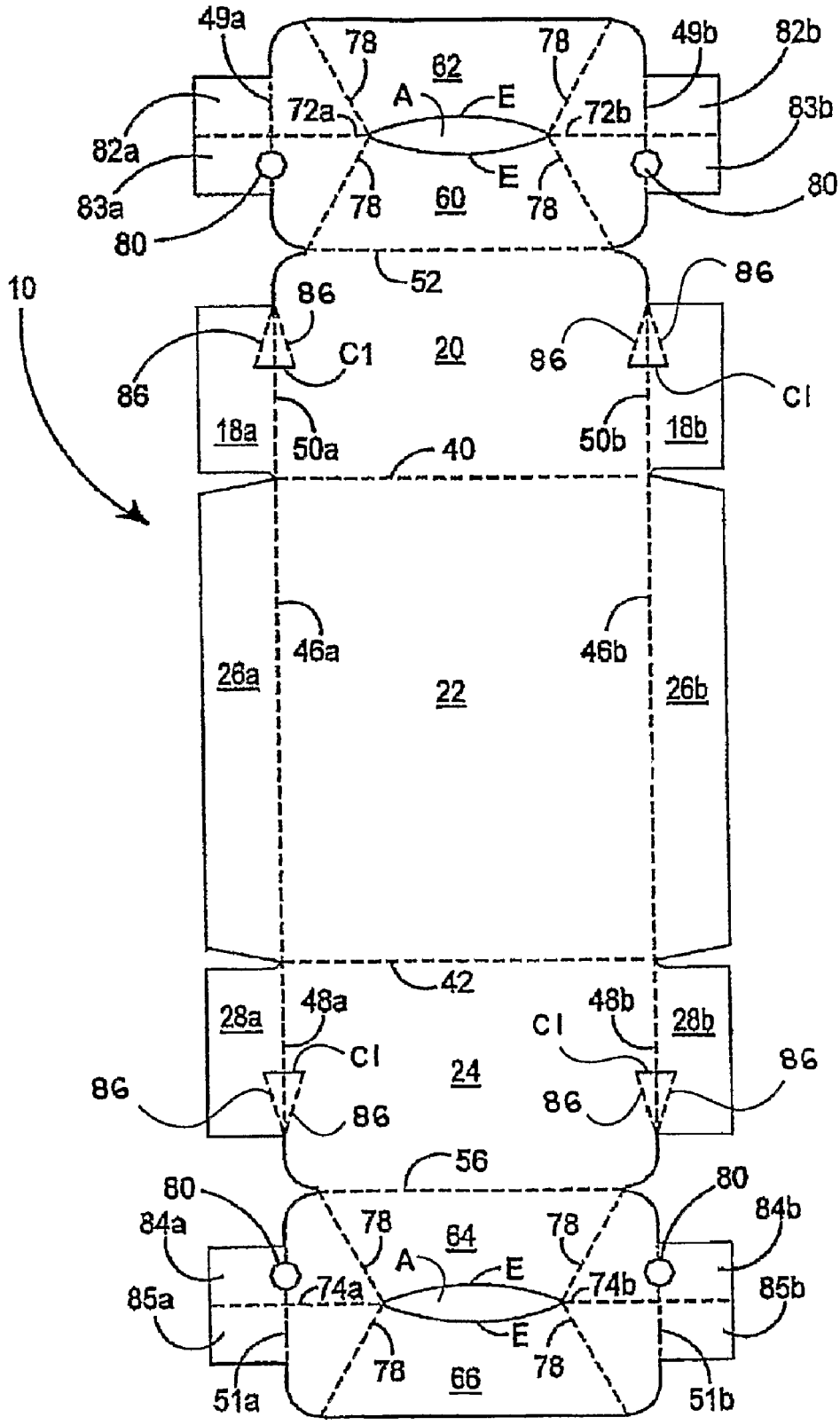
FIG. 1 is a plan view of a blank for forming a base of a carton, according to a first embodiment of the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model, or pattern. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings, wherein like numerals indicate like elements throughout the several views, the drawings illustrate certain of the various aspects of exemplary embodiments of a carton including a handle structure. The handle structure includes at least one handle panel that is disposed in an overlapping relationship with a wall of the carton to form a pocket for engaging and carrying the carton.

Figure 6:
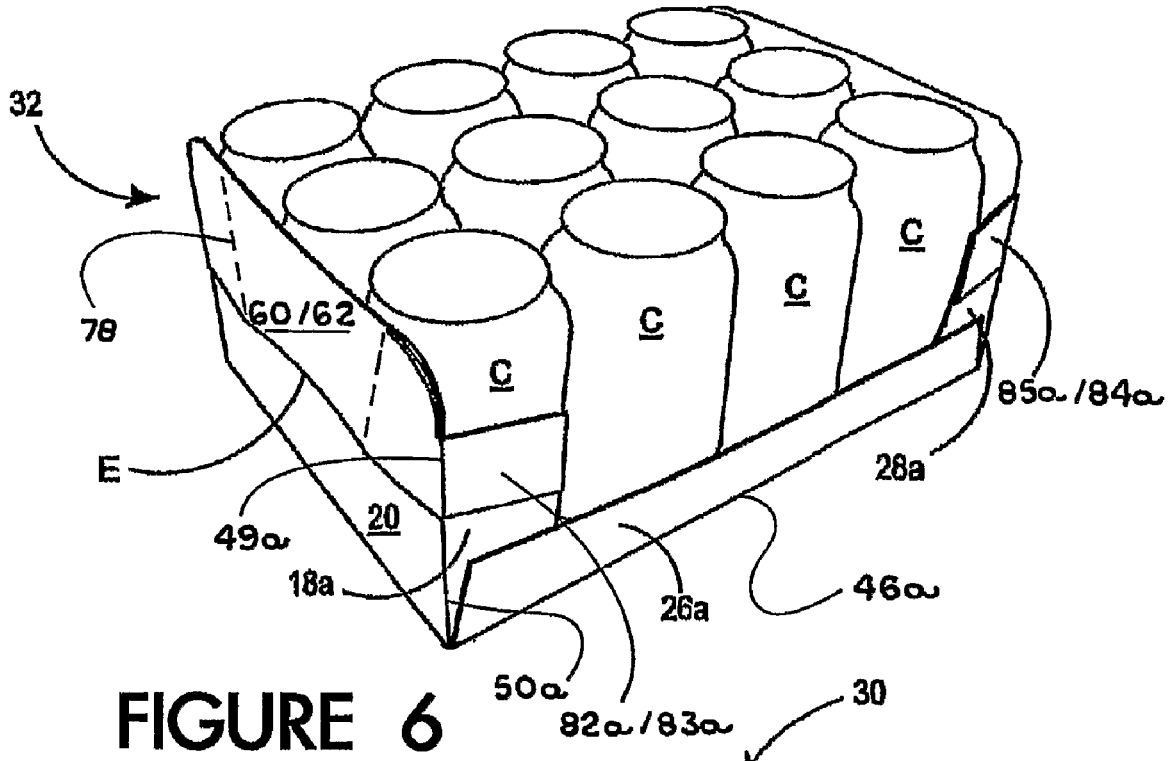
FIG. 6 is a perspective view of a base, the base being formed from the blank of FIG. 1.
Figure 7:
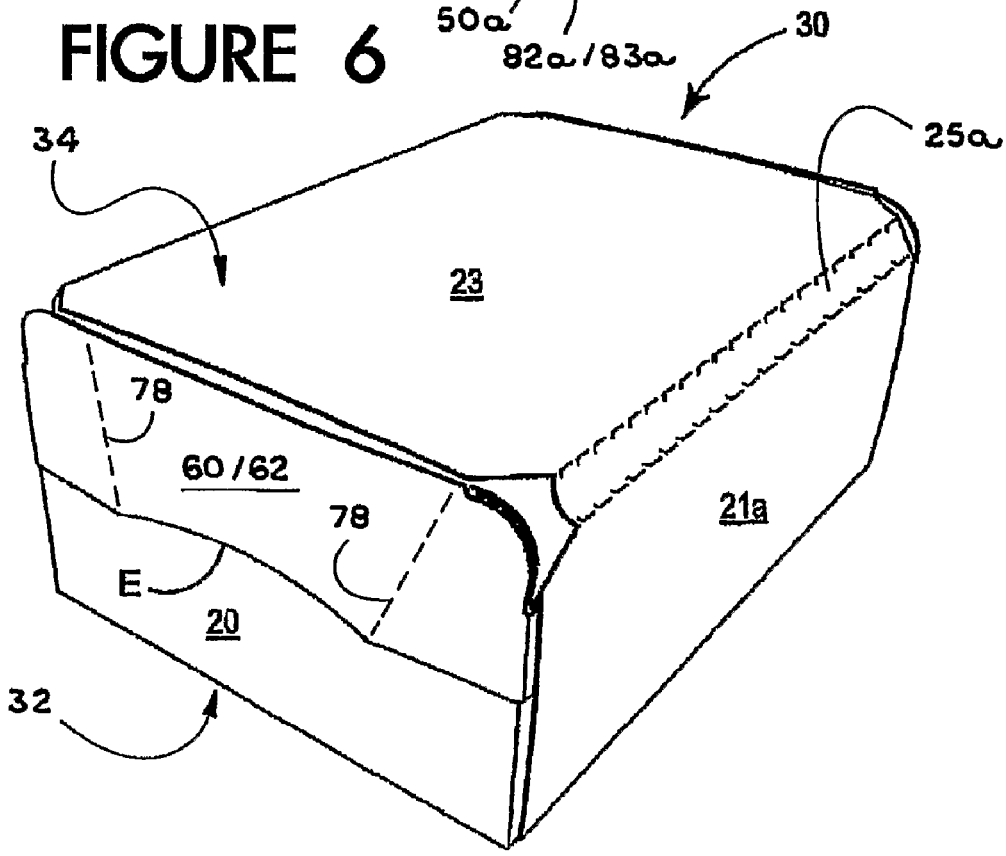
FIG. 7 is a perspective view of a carton, the carton being formed from the base of FIG. 6 and a top portion, the top portion being formed from the blank of FIG. 2.

Referring to FIG. 1, a blank 10 is shown that can be folded to form a base 32 (shown in FIG. 6). A blank 12 shown in FIG. 3 can be folded to form a top closure 34 (shown in FIG. 7). The top closure 34 and the base 32 can combine to form a carton 30, which is shown in FIG. 7. The blanks 10, 12 are elongated and are formed of paperboard. In alternative embodiments, the blanks 10, 12 can be formed of other foldable sheet material such as cardboard, plastic sheet, or the like. It should be noted that the cans C shown in FIG. 6, which are arranged in a 3×4 array, are included as an aid in understanding the invention. The scope of the invention is not limited to the type of articles shown or to the illustrated configuration.

Referring to FIG. 1, the blank 10 includes several primary panels that are hingedly connected, one to the next. The primary panels include a first side panel 20, a bottom panel 22, and a second side panel 24. The first side panel 20, the bottom panel 22, and the second side panel 24 are hingedly connected along fold lines 40, 42. The blank 10 includes end flaps to at least partially form an end closure structure. The end flaps are hingedly connected to the primary panels. More specifically, side end flaps 18*a*, 18*b*, 28*a*, 28*b* are hingedly connected to the respective first and second side panels 20, 24 along fold lines 50*a*, 50*b*, 48*a*, 48*b*. Bottom end flaps 26*a*, 26*b* are hingedly connected to the bottom panel 22 along fold lines 46*a*, 46*b*.

The blank 10 includes handle panels and handle end flaps for forming a handle structure. First and second inner handle panels 60, 64 are hingedly connected to the first and second side panels 20, 24 along fold lines 52, 56. Each of the inner handle panels 60, 64 is hingedly connected to an outer handle panel 62, 66 along interrupted fold lines 72*a*, 72*b*, 74*a*, 74*b*. The fold lines 72*a*, 72*b*, 74*a*, 74*b* are interrupted by an aperture A. The aperture A is substantially symmetric about an axis defined by corresponding pairs of fold lines 72*a*, 72*b*, 74*a*, 74*b*. The aperture is further defined by edges E. The blank 10 includes handle end flaps that are hingedly connected to the handle panels. Handle end flaps 82*a*, 82*b* are hingedly connected to outer handle panel 62 along fold lines 49*a*, 49*b*, handle end flaps 83*a*, 83*b* are hingedly connected to inner handle panel 60 along fold lines 49*a*, 49*b*, handle end flaps 84*a*, 84*b* are hingedly connected to inner handle panel 64 along fold lines 51*a*, 51*b*, and handle end flaps 85*a*, 85*b* are hingedly connected to outer handle panel 66 along fold lines 51*a*, 51*b*. Handle end flaps 82*a*, 82*b* are hingedly connected to handle end flaps 83*a*, 83*b* along fold lines 72*a*, 72*b* and handle end flaps 84*a*, 84*b* are hingedly connected to handle end flaps 85*a*, 85*b* along fold lines 74*a*, 74*b*.

In this, the first embodiment of the invention, the inner and outer handle panels 60, 64, 62, 66 are similarly shaped, elongate, and have substantially the same length as the first and second side panels 20, 24. The handle panels 60, 64, 62, 66 each comprise fold lines 78, which are specifically disposed to facilitate or otherwise control flexing of the handle panel structure when the carton 30 is lifted.

The blank 10 includes features that facilitate folding multiple plies of material and facilitate flexing of the handle structure. One of the features is an aperture 80 that is disposed at the hinged connection between each end flaps 83*a*, 83*b*, 84*a*, 84*b* and the respective adjacent inner handle panel 60, 64. Each aperture 80 interrupts a fold line 49*a*, 49*b*, 51*a*, 51*b* and is provided to reduce the amount of material present at the hinged connection. The shape and size of the aperture 80, and hence the amount of material removed from the blank 10 at a hinged connection, is a design choice that at least partially determines the ease in which multiple plies of material can be folded at the hinged connection. Another of the features that facilitate folding multiple plies of material is a triangular feature that is defined, in part, by converging fold lines 86. The converging fold lines 86 extend from the ends of a cut line C1. The triangular feature is disposed at the hinged connection between a side panel 20, 24 and an end flap 18*a*, 18*b*, 28*a*, 28*b*. Each cut line C1 is offset from, and substantially parallel to, a respective fold line 52, 56. Each cut line C1 is substantially perpendicular to a respective fold line 48*a*, 48*b*, 50*a*, 50*b*. The fold lines 48*a*, 48*b*, 50*a*, 50*b* substantially bisect a respective triangular arrangement and associated cut line C1. The triangular feature is deformable as described in more detail below.

Figure 2:
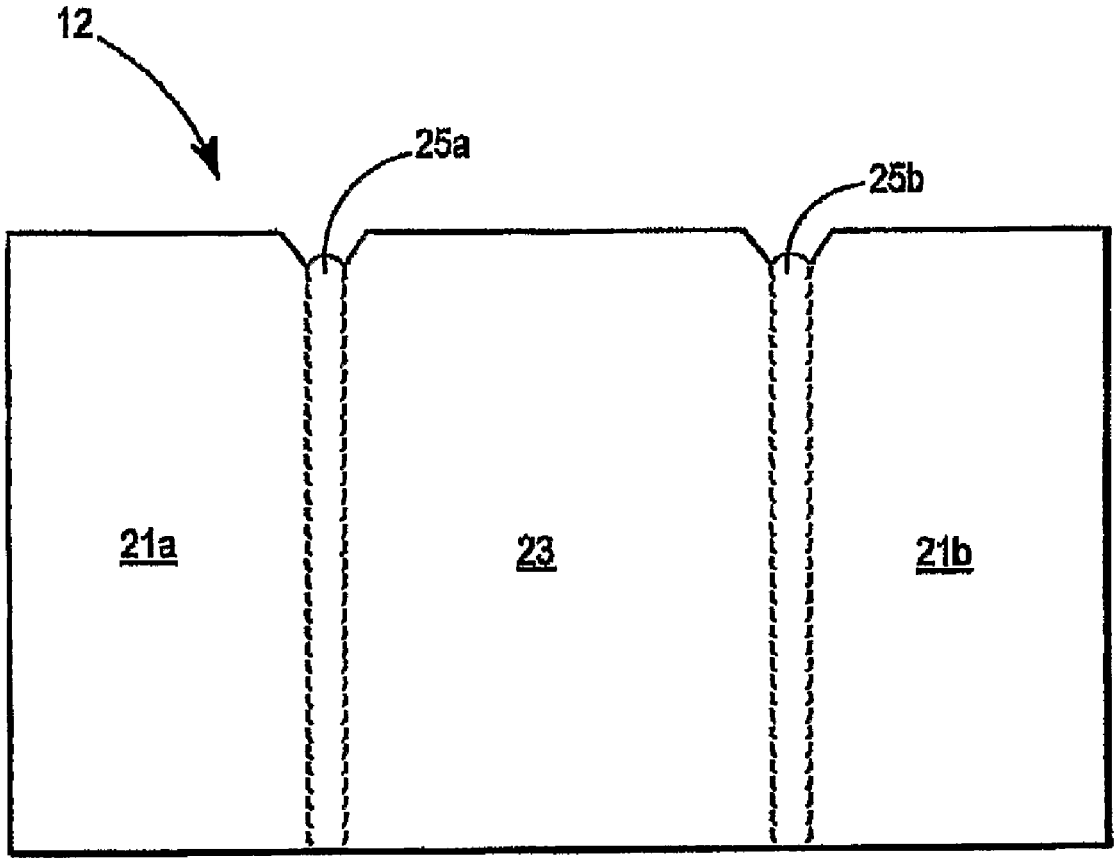
FIG. 2 is a plan view of a blank for forming a top portion of a carton.

Referring to FIG. 2, the blank 12 can be folded and secured to form a top closure 34 that is a cover for the carton base 32. The blank 12 includes a top panel 23 that is connected to end panels 21*a*, 21*b* by tear strips 25*a*, 25*b*, respectively.

A series of sequential folding and gluing operations are now described as a non-limiting method of forming the base 32 and the top closure 34 from blanks 10, 12. The series of sequential folding and gluing operations can be performed in a straight line machine, so that the blanks 10, 12 are not required to be rotated or inverted to complete the construction of the base 32 and the top closure 34. The folding process is not limited to that described below and can be altered according to particular manufacturing requirements.

Figure 3:
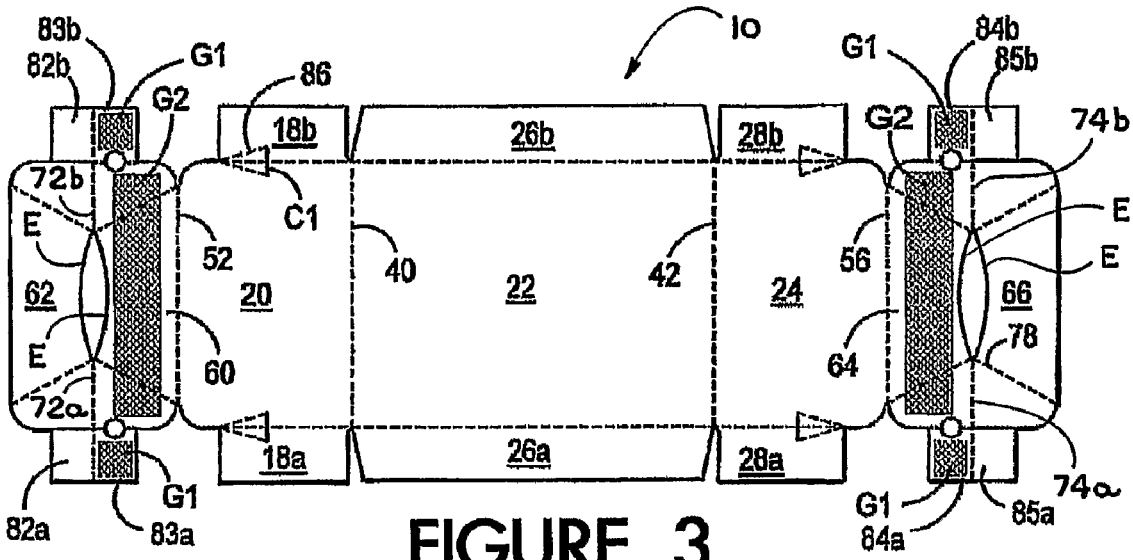
FIG. 3 is a plan view of the blank of FIG. 1, emphasizing areas to which adhesive is applied.

The method for forming the base 32 from the blank 10 is first described. Referring to FIG. 3, a plan view of the inside surface of the blank 10 is shown. An adhesive, such as glue, is applied to areas G1, G2 of the inside surface of the blank 10. Glue is applied to areas G2 of the inside surface of the inner handle panels 60, 64 such that, when the outer handle panels 62, 66 are folded about fold lines 72*a*, 72*b*, 74*a*, 74*b*, the inner and outer handle panels 60, 62, 64, 66 are adhered together to form composite handle panels 60/62, 64/66. Subsequently, the edges E of the apertures A substantially align to form cutouts. Similarly, glue can be applied to areas G1 of the inside surface of each of the end flaps 83*a*, 83*b*, 84*a*, 84*b* so that, when the handle end flaps 82*a*, 82*b*, 85*a*, 85*b* are folded about fold lines 72*a*, 72*b*, 74*a*, 74*b*, the handle end flaps are adhered together to form composite handle end flaps 83*a*/82*a*, 83*b*/82*b*, 84*a*/85*a*, 84*b*/85*b*. It should be noted that it is not necessary to apply glue at areas G1, G2 to secure the handle panels and handle end flaps in their folded position. Additional folding and securing sequences can secure the handle panels and the handle end flaps in their folded position.

Figure 4:
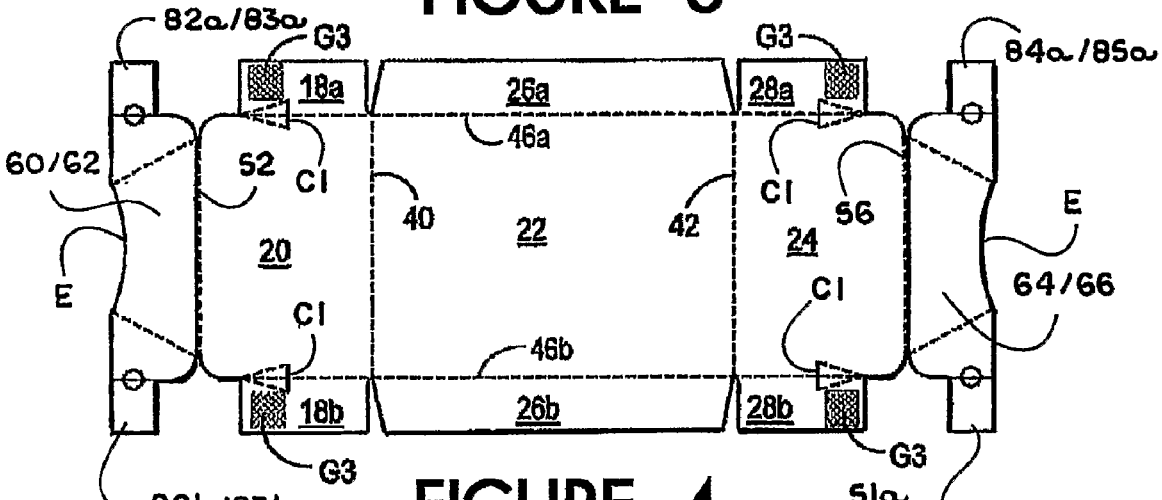
FIG. 4 is a plan view of the blank of FIG. 3, showing a first folding operation and emphasizing areas to which adhesive is applied.
Figure 5:
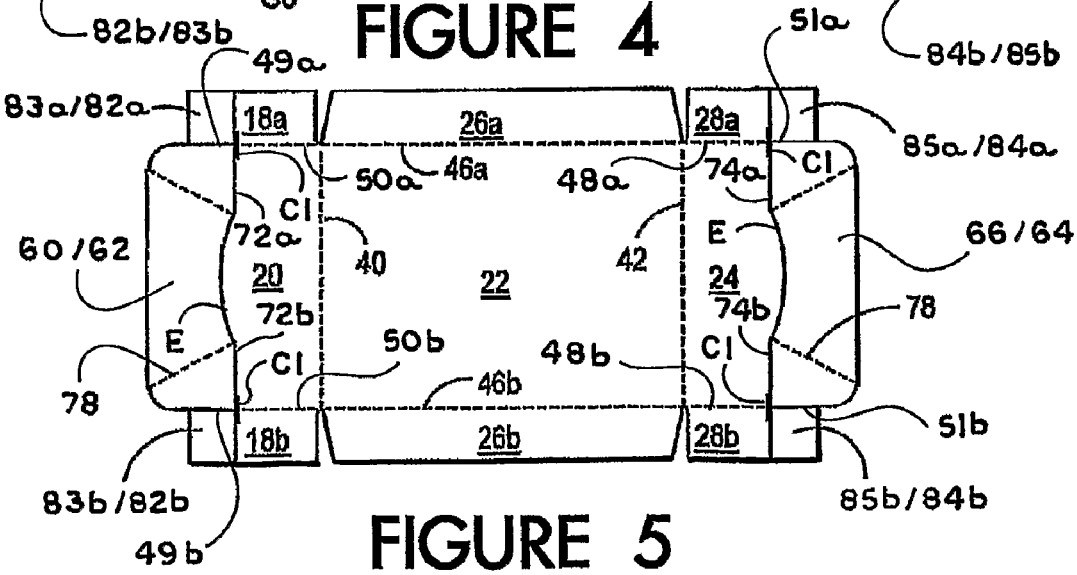
FIG. 5 is a plan view of the blank of FIG. 4, showing a second folding operation to place the blank in a partially erected condition.

Referring to FIGS. 4, 5, a plan view of the outside surface of the partially folded blank 10 is shown. Glue is applied to areas G3 of the side end flaps 18*a*, 18*b*, 28*a*, 28*b*. The composite handle panels 60/62, 64/66 are folded along fold lines 52, 56 into flat face contact with the outside surface of the first and second side panels 20, 24, respectively. Similarly, the composite handle end flaps 83*a*/82*a*, 83*b*/82*b*, 84*a*/85*a*, 84*b*/85*b* are in flat face contact with the side end flaps 18*a*, 18*b*, 28*a*, 28*b*. Thereby, the composite handle end flaps 83*a*/82*a*, 83*b*/82*b*, 84*a*/85*a*, 84*b*/85*b* are adhered to side end flaps 18*a*, 18*b*, 28*a*, 28*b*, respectively. A transverse carrying edge of each composite handle panel 60/62, 64/66, at least partially defined by fold lines 72*a*, 72*b*, 74*a*, 74*b*, is aligned with cut lines C1 (shown in FIG. 5).

The first and second side walls 20, 24 are folded towards the inside surface of the bottom panel 22 to be substantially perpendicular to the plane defined by the bottom panel 22. Although, in alternative embodiments, the side walls of the base may be sloped somewhat. More specifically, the side panels 20, 24 are folded about fold lines 40, 42. The side end flaps 18*a*, 18*b*, 28*a*, 28*b* are folded about the fold lines 50*a*, 50*b*, 48*a*, 48*b* toward the inside surface of the respective side panel 20, 24 to be substantially perpendicular to the plane defined by the side panel 20, 24. As the side end flaps 18*a*, 18*b*, 28*a*, 28*b* are folded about the fold lines 50*a*, 50*b*, 48*a*, 48*b*, the attached composite end flaps 83*a*/82*a*, 83*b*/82*b*, 84*a*/85*a*, 84*b*/85*b* accordingly fold about fold lines 49*a*, 49*b*, 51*a*, 51*b*. Thus, three plies of the blank 10 are folded. The apertures 80 and the triangular structure are provided, as described above, to facilitate folding the three plies.

The bottom end flaps 26*a*, 26*b* are folded about fold lines 46*a*, 46*b* to be, at least partially, in flat face contact with a respective side end flap 18*a*, 18*b*, 28*a*, 28*b*. The bottom end flaps 26*a*, 26*b* can be partly coated with adhesive such that, as the bottom end flaps 26*a*, 26*b* are folded, they can be secured to adjacent side end flaps 18*a*, 18*b*, 28*a*, 28*b*. The carton base 32 is thereby formed from the blank 10, as shown in FIG. 6. The carton base 32 can subsequently be loaded with cans C, as illustrated, or with other similar containers.

The top closure 34 is formed from the blank 12 by folding the end panels 21*a*, 21*b* to be substantially perpendicular to the plane of the top panel 23. The carton 30 is then formed by first aligning the top panel 23 with the carton base 32. Glue, or other securing means, may be employed between the inside surface of the end panels 21*a*, 21*b* and the outside surface of bottom flaps 26*a*, 26*b* to secure the top closure 34 to the carton base 32, thereby forming the end closure structures and completing the formation of the carton 30 (shown in FIG. 7). In alternative embodiments, the end panels 21*a*, 21*b* can be secured to the composite handle end flaps 83*a*/82*a*, 83*b*/82*b*, 84*a*/85*a*, 84*b*/85*b* or the side end flaps 18*a*, 18*b*, 28*a*, 28*b* to form the end closure structures.

Figure 8:
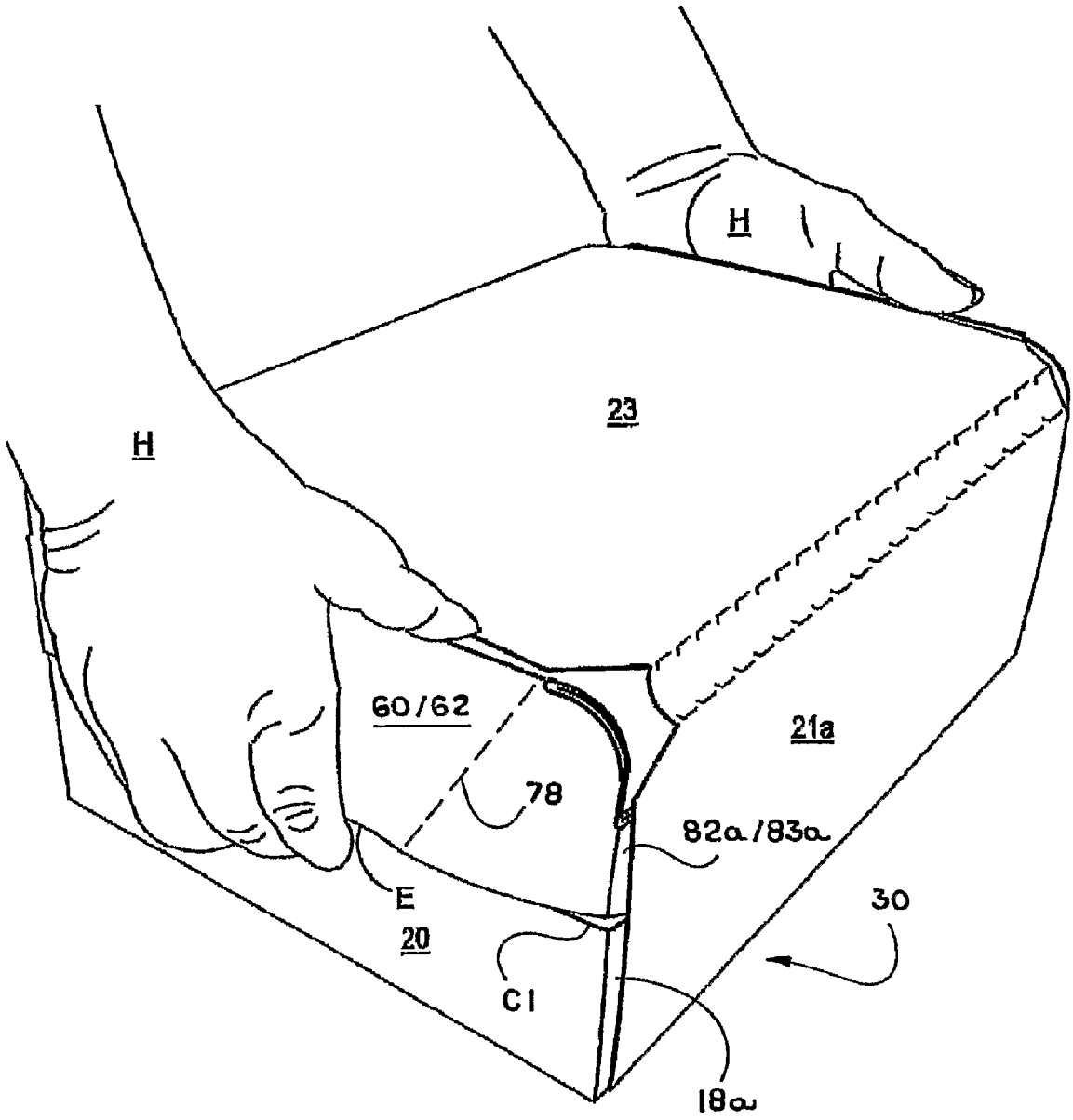
FIG. 8 is a perspective view of the carton of FIG. 7, the carton including handle structures that are engaged by a user's hands.

The erected side panels 20, 24 are now referred to as the side walls 20, 24 of the carton 30. The composite handle panels 60/62, 64/66 and the composite handle end flaps 83*a*/82*a*, 83*b*/82*b*, 84*a*/85*a*, 84*b*/85*b* at least partially form handle structures. Each handle structure, together with a respective adjacent side wall 20, 24, forms a pocket. The transverse carrying edge of each of the composite handle panels 60/62, 64/66 is at least partially defined by the edges E to complement the shape of a user's hand H. The increased thickness of the transverse carrying edge provides additional comfort to a user's hand H. As shown in FIG. 8, the transverse carrying edge can be readily engaged by a user's fingers or palm once the user's fingers have been inserted into the pocket. Since the inner handle panels 60, 64 of the handle structure are hingedly connected to the adjacent first or second side wall 20, 24 along an uninterrupted fold line 52, 56, a strong connection is provided by which the carton can be carried.

It is envisaged that the each handle structure can be formed by the inner handle panels 60, 64 and the end flaps 83*a*, 83*b*, 84*a*, 84*b* without reinforcement provided by the outer handle panels 62, 66 and the handle end flaps 82*a*, 82*b*, 85*a*, 85*b*. The outer handle panels 62, 66 provide reinforcement and thickness to the transverse carrying edge where a user engages the handle structure. Conversely, it is envisaged that more than one reinforcing panels can be included in the blank 10 to provide additional thickness, or to reinforce, the handle structures.

Referring to FIG. 8, the engagement of the handle structures by a user's hands H is shown. The fold lines 78 are provided to facilitate flexing or control deformation of the handle structure. The bending of the composite handle panels 60/62, 64/66 along the fold lines 78 increases the width of the pocket which enables the carton to be easily and comfortably lifted.

The cut lines C1, which are disposed in each corner defined by a side wall 20, 24 and an adjacent side end flap 18*a*, 18*b*, 28*a*, 28*b*, are provided to allow each triangular feature to be deformed or otherwise displace from their respective corner. The triangular features deform as the composite handle panels 60/62, 64/66 are engaged to allow the portions of the handle panel structure adjacent to each corner, including the composite handle end flaps 83*a*/82*a*, 83*b*/82*b*, 84*a*/85*a*, 84*b*/85*b*, to displace inwardly. This displacement allows the opening of the pocket to be widened and the composite handle panels 60/62, 64/66 to displace from the side walls 20, 24. The displacement can additionally facilitate transfer of the lifting force on the handle structures to the side end flaps 18*a*, 18*b*, 28*a*, 28*b*.

In subsequent embodiments, like reference numbers are used to identify panels, end flaps, and features which are similar to those of the first embodiment. The like reference numbers are raised by a factor of 100, 200, 300, or 400 to distinguish between the embodiments. Since the subsequent embodiments share similar features to the first embodiment, only certain differences will be described in detail.

Figure 9:
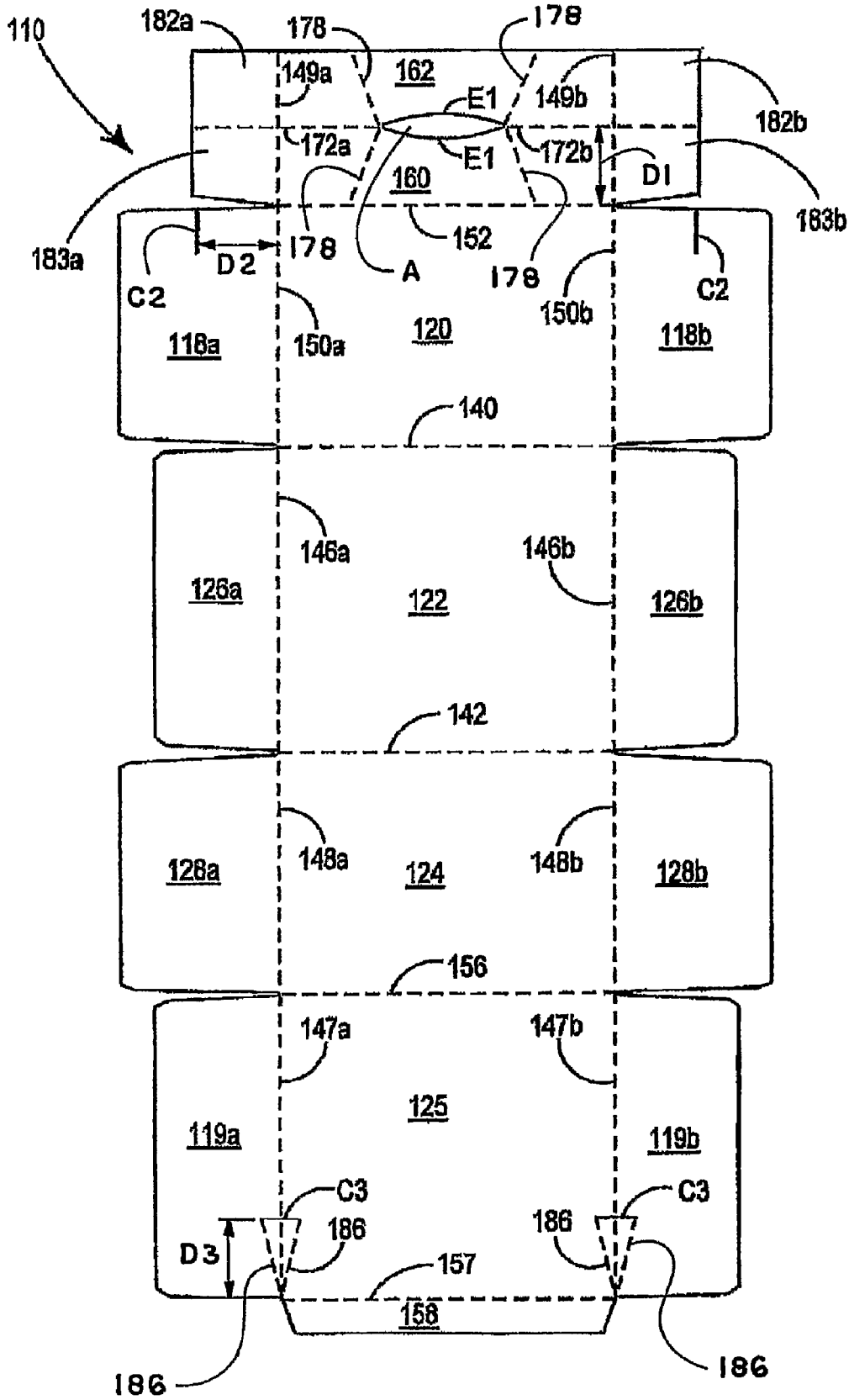
FIG. 9 is a plan view of a blank for forming a carton, according to a second embodiment of the present invention.

A second embodiment of the present invention is illustrated in FIGS. 9-15. Referring to FIG. 9, a unitary blank 110 is shown that can be folded and secured to form a fully enclosed carton 130 (shown in FIGS. 14 and 15), which includes one handle structure. The blank 110 includes several primary panels that are hingedly connected, one to the next. The primary panels include a first side panel 120, a bottom panel 122, a second side panel 124, and a top panel 125. The primary panels 120, 122, 124, 125 are hingedly connected along fold lines 140, 142, 156. Additionally, a edge flap 158 is hingedly connected to the top panel 125 along a fold line 157.

The blank 110 includes end flaps for forming end closure structures of the carton 130. End flaps 118*a*, 118*b*, 126*a*, 126*b*, 128*a*, 128*b*, 119*a*, 119*b* are hingedly connected to a primary panel 120, 122, 124, 125 along a respective fold line 150*a*, 150*b*, 146*a*, 146*b*, 148*a*, 148*b*, 147*a*, 147*b*.

The blank 110 includes handle panels and handle end flaps for forming a handle structure. An outer handle panel 160 is hingedly connected to the first side panel 120 along a fold line 152. An inner handle panel 162 is hingedly connected to the outer handle panel 160 along interrupted fold lines 172*a*, 172*b*. The fold lines 172*a*, 172*b* are interrupted by an aperture A. The aperture A is substantially symmetric about the axis defined the fold lines 172*a*, 172*b*, and is defined by edges E1. The inner and outer handle panels 162, 160 are hingedly connected to handle end flaps 182*a*, 182*b*, 183*a*, 183*b* along fold lines 149*a*, 149*b*. The inner and outer handle panels 162, 160 include fold lines 178, which divergingly extend from ends of the edges E1 to the edge of a handle panel 162, 160.

The blank 110 includes features that facilitate folding multiple plies of material or to provide flexibility of the handle structures of the carton 130. A triangular arrangement is provided at the hinged connection between the top panel 125 and the adjacent end flaps 119*a*, 119*b*. Each triangular arrangement is defined by fold lines 186 and cut lines C3. The cut lines C3 are offset from, and substantially parallel to, the fold line 157 by a distance D3. Fold lines 186 extend from the ends of a respective cut line C3 and converge at a point that is substantially adjacent to the intersection of the fold line 157 and an adjacent fold line 147*a*, 147*b*. The fold lines 147*a*, 147*b* substantially bisect a respective triangular arrangement and associated cut line C3. Additionally, cut lines C2 are provided in each of the end flaps 118*a*, 118*b*. The cut lines C2 are offset from, and substantially parallel to, an adjacent fold line 150*a*, 150*b* by a distance D2. The distances D2, D2 are substantially equal to a distance D1, which is defined as the distance between the fold line 152 and the fold lines 172*a*, 172*b*, such that the cut lines C2, C3 align as the carton 130 is formed from the blank 110 as described below.

Figure 10:
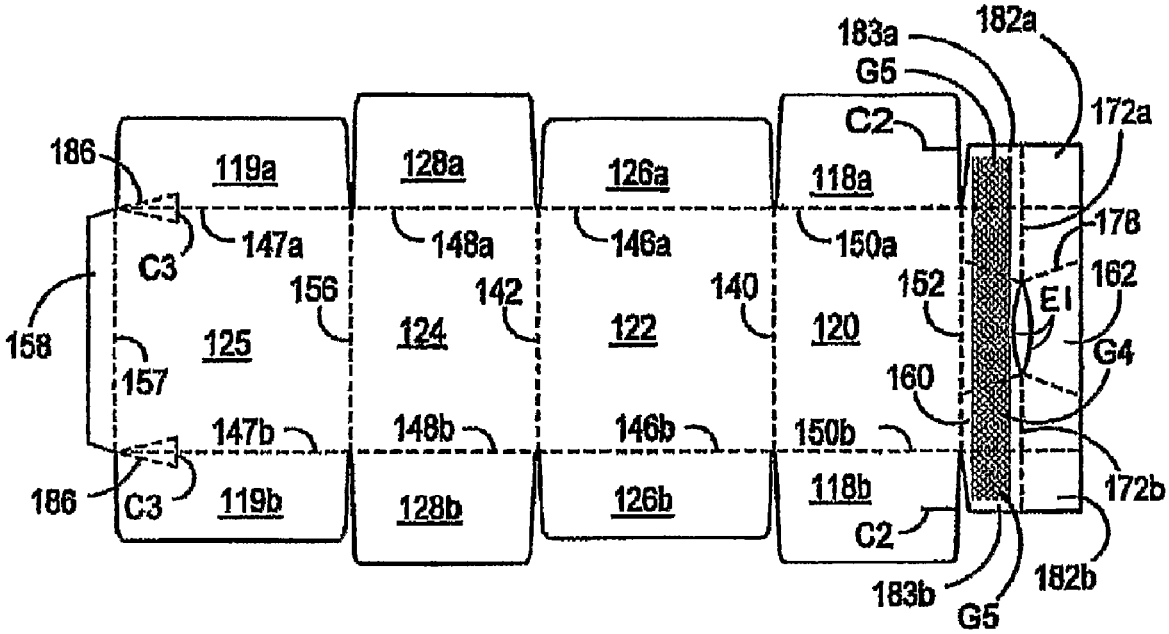
FIG. 10 is a plan view of the blank of FIG. 9, emphasizing areas to which adhesive is applied.
Figure 11:
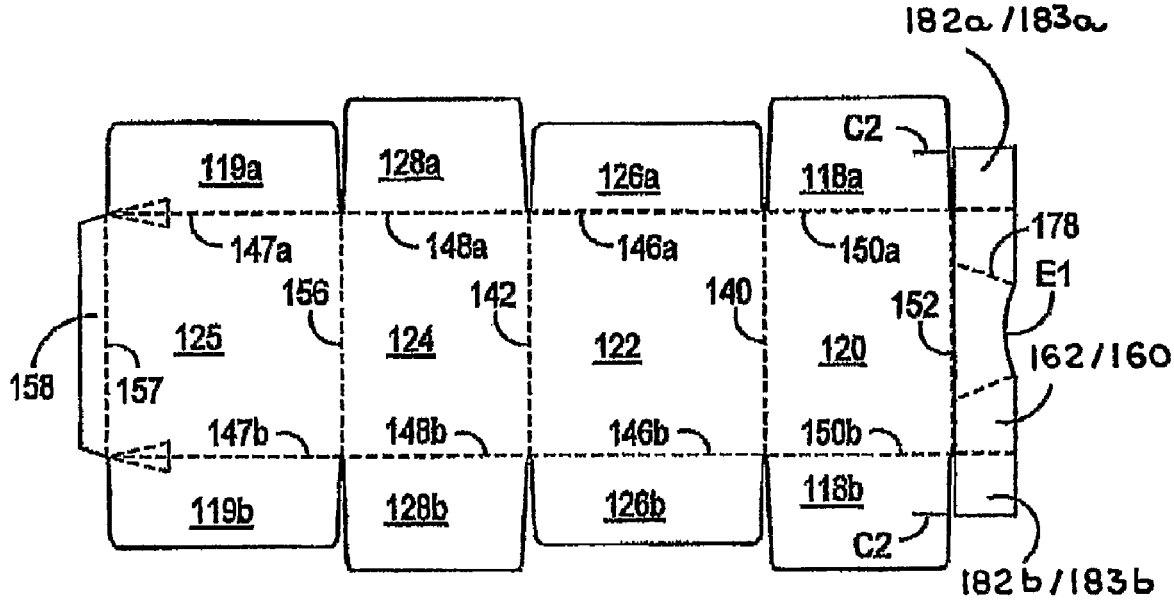
FIG. 11 is a plan view of the blank of FIG. 10, showing a first folding operation.

Referring to FIGS. 10-13, a series of sequential folding and gluing stages are now described as a non-limiting method for forming the carton 130 from the blank 110. Referring to FIGS. 10, 11, glue is applied to areas G4 of the inside surface of the outer handle panel 160 and glue is applied to areas G5 of the inside surface of the handle end flaps 183*a*, 183*b*. The inner handle panel 162 and the handle end flaps 182*a*, 182*b* are folded along fold lines 172*a*, 172*b* to be in flat face contact with the outer handle panel 160 and the handle end flaps 183*a*, 183*b*. Thereby, the inside surface of the outer handle panel 160 is adhered to the inside surface of the inner handle panel 162 to form a composite handle panel 160/162. Similarly, the inside surface of each handle end flap 183*a*, 183*b* is adhered to the inside surface of a respective handle end flap 182*a*, 182*b* to form composite handle end flaps 182*a*/183*a*, 182*b*/183*b*. A transverse carrying edge of the composite handle panel 160/162 is at least partially defined by the fold lines 172*a*, 172*b* and the edges E1.

Figure 12:
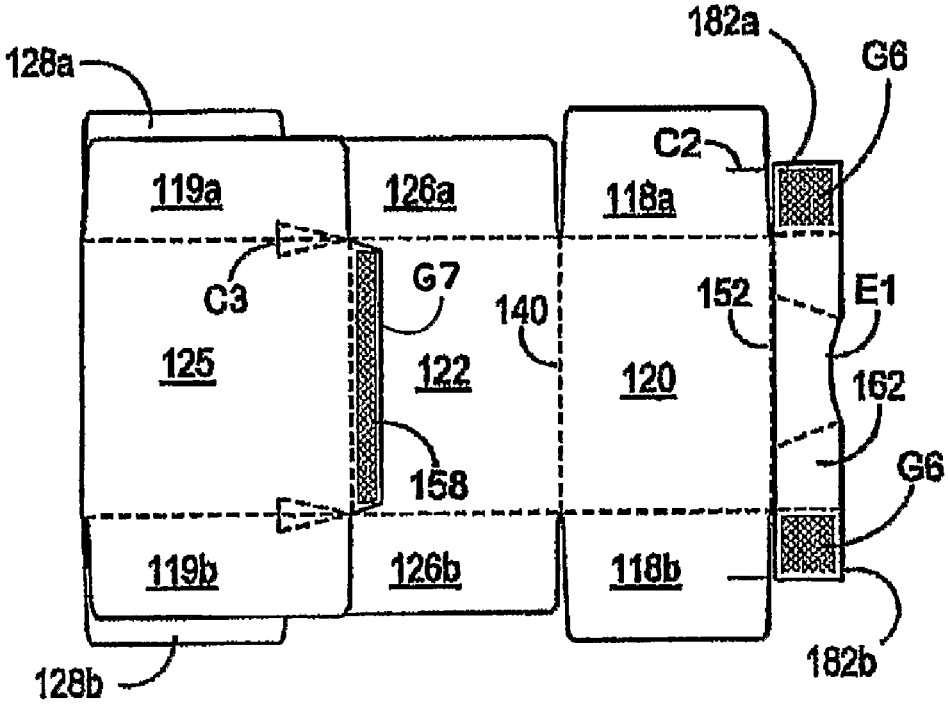
FIG. 12 is a plan view of the blank of FIG. 11, showing a second folding operation and emphasizing areas to which adhesive is applied.
Figure 13:
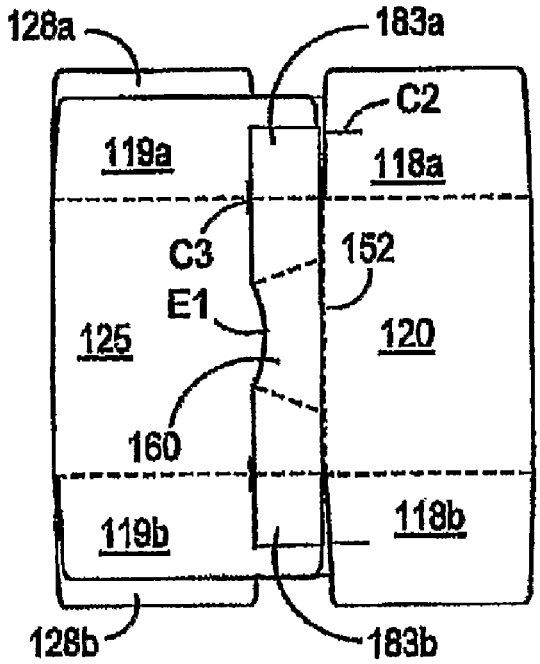
FIG. 13 is a plan view of the blank of FIG. 12, showing a third folding operation.

Referring to FIGS. 11, 12, the top panel 125 is folded about the fold line 156 so that the inside surface of top panel 125 lies in flat face contact with the inside surface of the second side panel 124. Glue is applied to area G7 of the outside surface of the glue flap 158 and glue is applied to areas G6 of the outside face of each of the handle end flaps 182*a*, 182*b*. Referring to FIGS. 12, 13, the first side panel 120 is folded along fold line 140, such that the inside surface of the first side panel 120 lies in flat face contact with the inside surface of the bottom panel 122 and outside surface of edge flap 158. The first side panel 120 is thereby adhered to the glue flap 158. The composite handle end flaps 182*a*/183*a*, 182*b*/183*b* are thereby adhered to respective top end flaps 119*a*, 119*b*. The transverse carrying edge of the composite handle panel 160/162 substantially aligns with the cut lines C3. It should be noted that applying glue to the areas G4, G5 is optional since applying glue to areas G6 can sufficiently and securely hold the inner and outer handle panels 162, 160 and handle end flaps 182*a*, 183*a*, 182*b*, 183*b* in the folded positions described above.

Figure 14:
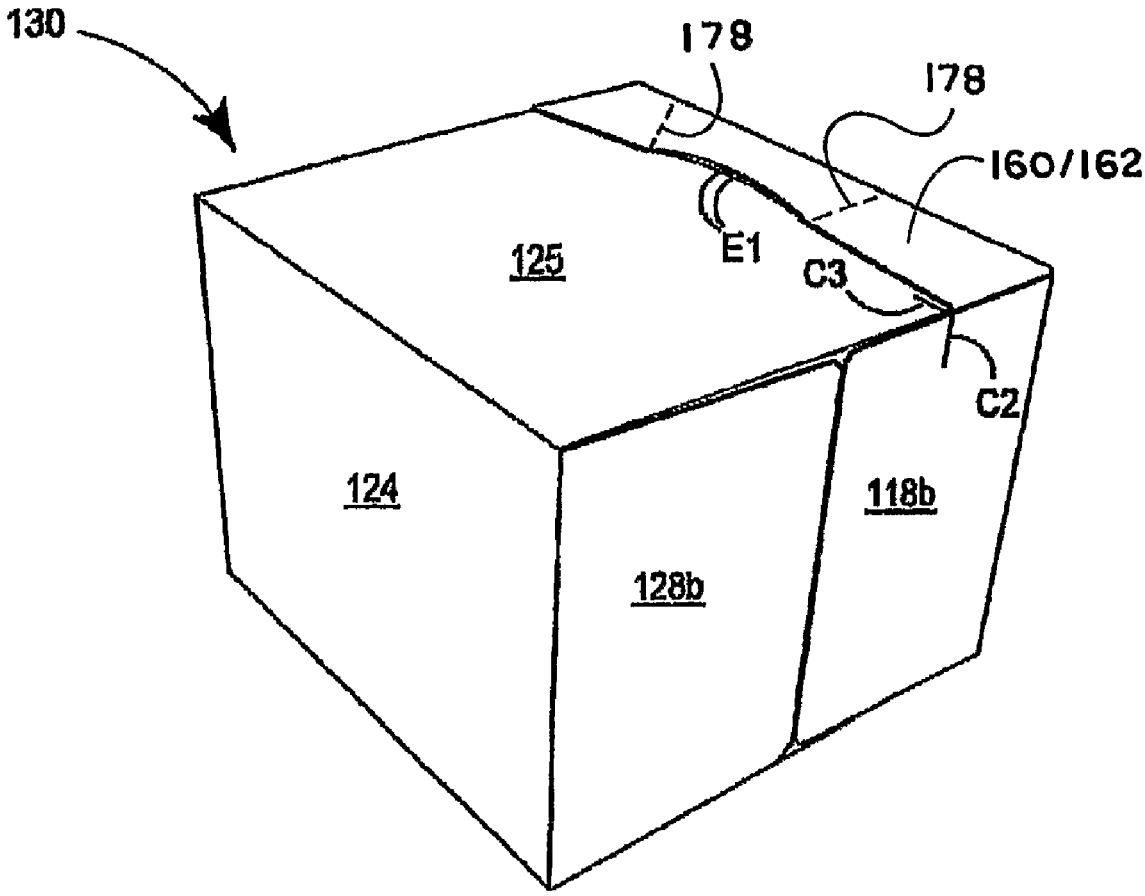
FIG. 14 is a perspective view of a carton, the carton being formed from the blank of FIG. 9.

The folded carton blank 110 shown in FIG. 13 can be erected into a tubular sleeve which can be loaded through one or both ends. Once loaded, the end flaps 118*a*, 118*b*, 119*a*, 119*b*, 126*a*, 126*b*, 128*a*, 128*b* are folded and secured to form the end closure structures 132, 134 of the carton 130. The side end flaps 118*a*, 118*b* overlap the top end flaps 119*a*, 119*b* such that the composite handle end flaps 182*a*/183*a*, 182*b*/183*b* are disposed in between. Referring to FIG. 14, cut lines C2 are brought into alignment with at least a portion of cut lines C3 and with the transverse carrying edge of the handle structure. The cut lines C2, C3 and the deformable triangular features facilitate deformation the handle structure and of portions of the end closure structures 132, 134 of the carton 130 when the pocket handle is engaged. This deformation allows the composite handle panel 160/162 to flex or displace to facilitate engaging the handle structure. More specifically, the opening of a pocket that is formed between the handle structure and the top panel 125 can be enlarged to fit a user's hand.

Figure 15:
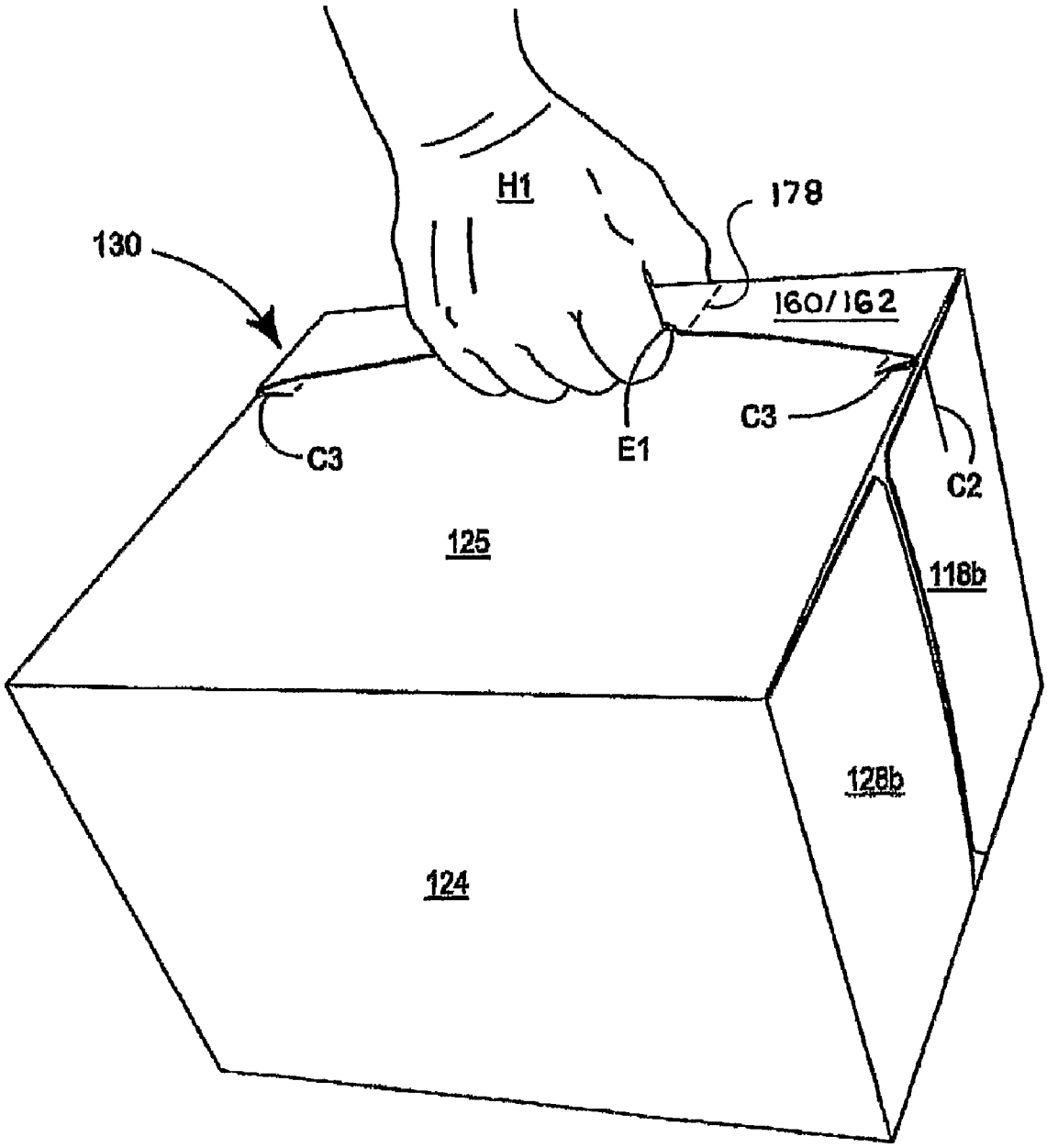
FIG. 15 is a perspective view of the carton of FIG. 14, the carton including a handle structure that is engaged by a user's hand.

The handle structure and the top panel 125 define a pocket that can be engaged to carry the carton 130. The composite end flaps 182*a*/183*a*, 182*b*/183*b* are folded and secured as described above to close the ends of the pocket. Thus, access into the pocket is provided adjacent to the transverse carrying edge of the composite handle panel 160/162. Engagement of the handle structure or the pocket is shown in FIG. 15 where a hand H1 can be inserted into the pocket. In this embodiment, the back of the hand H1 is shielded from the carton contents. As the user's hand H1 is inserted into the pocket, the fold lines 178 facilitate flexing or otherwise control deformation of the composite handle panel 160/162. The deformed composite handle panel 160/162 provides a wider opening of the pocket to assist in the user's engagement of the pocket.

As the pocket is engaged, the force applied to the handle structure to carry the carton is transferred from the carrying transverse edge to the edges or ends of the handle structure that are anchored to the carton walls. The cut lines C2, C3 allow the anchored composite end flaps 182*a*/183*a*, 182*b*/183*b*, and adjacent attached portions of the side and top end flaps 118*a*/118*b* and 119*a*/119*b*, which make up portions of the end closure structures 132, 134, to displace inwardly. The displacement, as described herein, allows the end closure structures 132, 134 and the handle structure to flex, which widens the opening of the pocket. The displacement also facilitates transferring the force applied to the handle structure to the end closure structures 132, 134. The handle structure is therefore easily engaged, readily accessible, comfortable to use, and very strong.

Figure 16A:
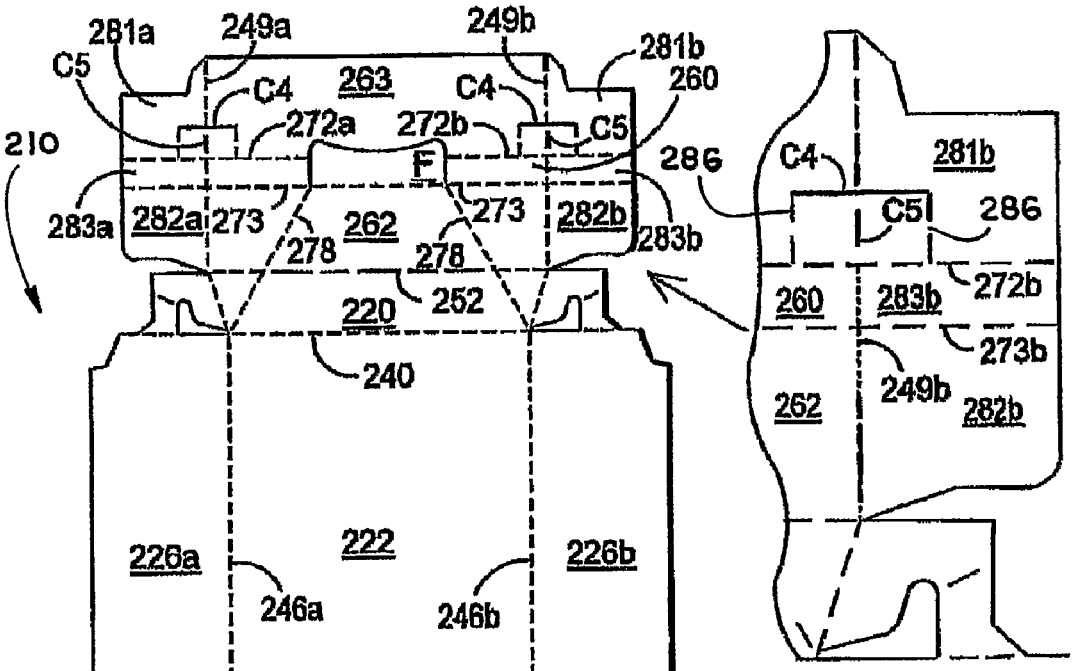
FIG. 16A is an enlarged plan view of a portion of the blank of FIG. 16.
Figure 16:
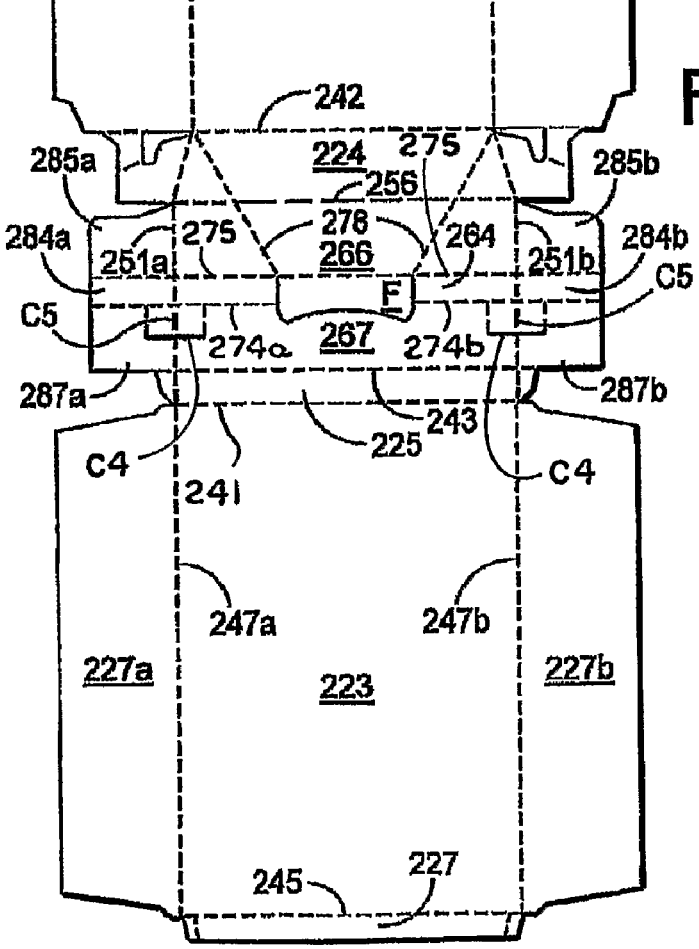
FIG. 16 is a plan view of a blank for forming a carton, according to a third embodiment of the invention.

A third embodiment of the present invention is illustrated in FIGS. 16-22. A blank 210 is shown in FIG. 16 that can be folded and secured to form a carton 230 (shown in FIGS. 21 and 22). The blank 210 includes primary panels including top, bottom, and side panels. In this embodiment, the side panels each include multiple hingedly connected panels such that the side walls of the carton 230, which are at least partially formed by the side panels, are shaped to complement the shape of articles contained in the carton 230. Further, in this embodiment, handle panels are integral to a respective side panel such that handle structures are at least partially formed in the side walls of the carton 230.

The blank 10 includes a top panel 222, a bottom panel 223, first side panels 263, 220, and second side panels 224, 267, 225. The blank 210 includes handle panels for forming handle structures including first inner and outer handle panels 260, 262, and second inner and outer handle panels 266, 264. The first side panels 263, 220 are separated by the first handle panels 260, 262. More specifically, the panels 263, 260, 262, 220 are hingedly connected one to the next in series along fold lines 272*a*, 272*b*, 273, 252. The second side panels 224, 267 are separated by the second handle panels 266, 264. More specifically, the panels 224, 266, 264, 267, 225 are hingedly connected one to the next in series along fold lines 256, 275, 274*a*, 274*b*, 243. Side panel 220, 224 are hingedly connected to the top panel 222 along fold line 240, 242 and side panel 225 is hingedly connected to the bottom panel 223 along fold line 241. An edge flap 227 is hingedly connected to the bottom panel along fold line 245.

Then blank 210 includes end flaps 226*a*, 226*b*, 227*a*, 227*b*, 281*a*, 281*b*, 287*a*, 287*b* that are hingedly connected to the panels 222, 223, 263, 267 along fold lines 246*a*, 246*b*, 247*a*, 247*b*, 249*a*, 249*b*, 251*a*, 251*b*. The blank 210 includes handle end flaps 282*a*, 282*b*, 283*a*, 283*b*, 284*a*, 284*b*, 285*a*, 285*b* that are hingedly connected to handle panels 260, 262, 264, 266 along fold lines 249*a*, 249*b*, 251*a*, 251*b*.

In this embodiment, the inner handle panels 260, 264 are formed from narrow strips of material to reduce the amount of material required to form the handle structure. Each inner handle panel 260, 264 includes a handle flap F. Each handle flap F is hingedly connected to an outer handle panel 262, 266 along fold lines 273, 275. Each handle flap F extends across an inner handle panel 260, 264 and into an adjacent portion of a side panel 263, 267.

Features that facilitate folding multiple plies of material, or relief mechanisms, such as triangular features and cut lines have been described herein in the previous embodiments. In this embodiment, a relief mechanism is provided at a hinged connection between side panels 263, 267 and end flaps 281*a*, 281*b*, 287*a*, 287*b*. Each relief mechanism is at least partially defined by a pair of perpendicular cut lines C4, C5 that, preferably, do not intersect. Referring to FIG. 16A, a detail or enlarged view of a section of the blank 210 is illustrated. The illustrated section includes portions of the first side panel 263, the handle panels 260, 262, the end flap 281*b*, and handle end flaps 283*b*, 282*b*. Since the relief mechanisms are substantially identical, only the relief mechanism illustrated in FIG. 16A will be described. The cut line C5 is disposed along the fold line 249*b*, adjacent to the fold line 272*b*. The cut line C4 is offset from the fold line 272*b* and disposed on the first side panel 236 and the end flap 281*b*. Fold lines 286 extend from each end of the cut line C4 to the fold line 272*b*. The fold lines 286 are substantially parallel to the fold line 249*b*. The cut line C5 weakens the fold line 249*b* such that the relief mechanism is easily deformable. In alternative embodiments, the fold line 249*b* may be weakened by a series of half cuts running along the fold line 249*b*.

Figure 17:
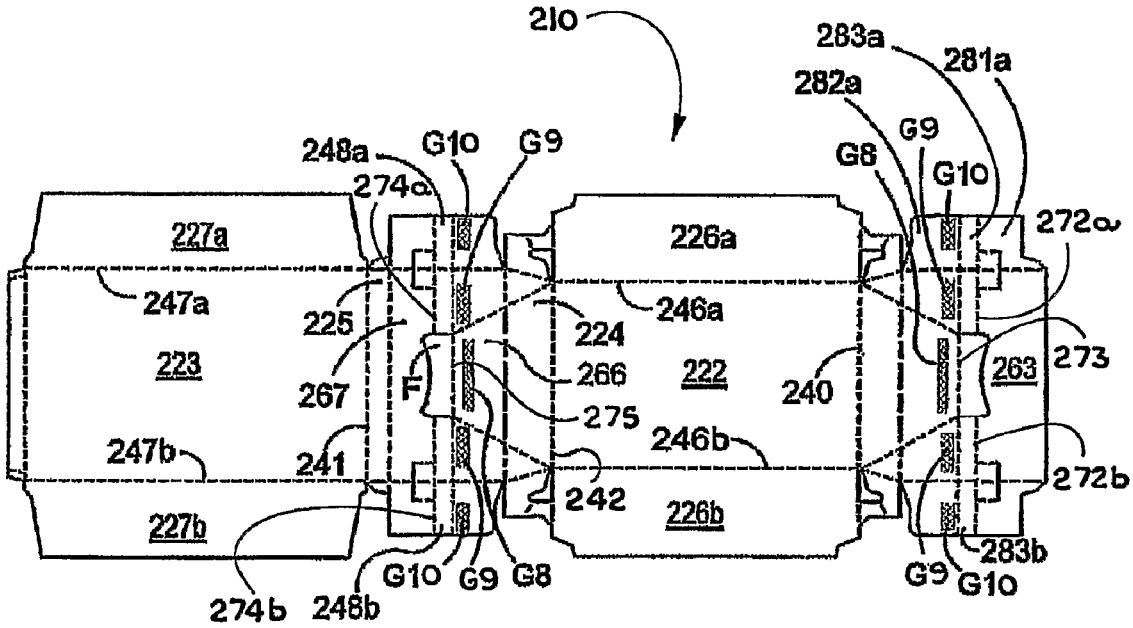
FIG. 17 is a plan view of the blank of FIG. 16, emphasizing areas to which glue is applied.
Figure 18:
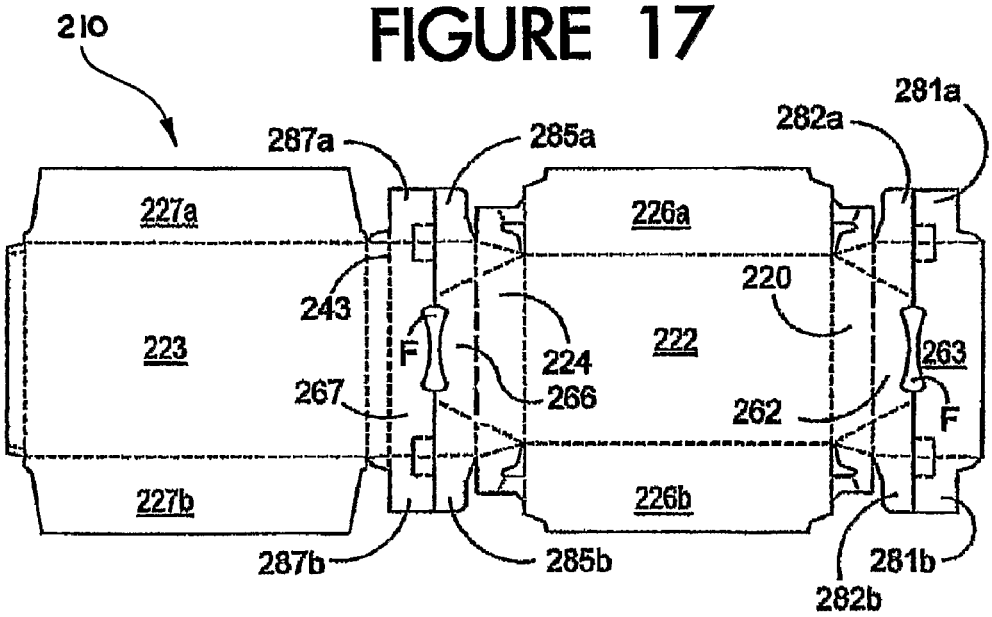
FIG. 18 is a plan view of the blank of FIG. 17, showing a first folding operation.

Referring to FIGS. 17-20, the carton 230 is formed by a sequence of folding and gluing steps. Referring to FIG. 17, glue is applied to areas G8, G9 of the inside surface of the of the outer handle panels 262, 266. Glue is applied to areas G10 of the inside surface of each handle end flap 282*a*, 282*b*, 251*a*, 251*b*. Referring to FIGS. 17 and 18, the blank 210 is folded along fold line 273 such that the inside surface of inner handle panel 260 and the inside surface of the handle flap F are in flat face contact with the inside surface of outer handle panel 262. Further, the blank 210 is folded along fold lines 272*a*, 272*b* such that the outside surface of the inner handle panel 260 is in flat face contact with the outside surface of the side panel 263. Subsequently, the inside surface of the handle end flaps 283*a*, 283*b* are in flat face contact with inside surface of the handle end flaps 282*a*, 282*b*, respectively, and the outside surface of the handle end flaps 283*a*, 283*b* are in flat face contact with the outside surface of the end flaps 281*a*, 281*b*.

The blank 210 is folded along fold lines 275 such that the inside surface of inner handle panel 264, and the inside surface of the handle flap F, are in flat face contact with the inside surface of outer handle panel 266. Further, the blank 210 is folded along fold lines 274*a*, 274*b* such that the outside surface of the inner handle panel 264 is in flat face contact with the outside surface of the side panel 267. Subsequently, the inside surface of the handle end flaps 284*a*, 284*b* are in flat face contact with inside surface of the handle end flaps 285*a*, 285*b*, respectively, and the outside surface of the handle end flaps 284*a*, 284*b* are in flat face contact with the outside surface of the end flaps 287*a*, 287*b*.

Figure 19:
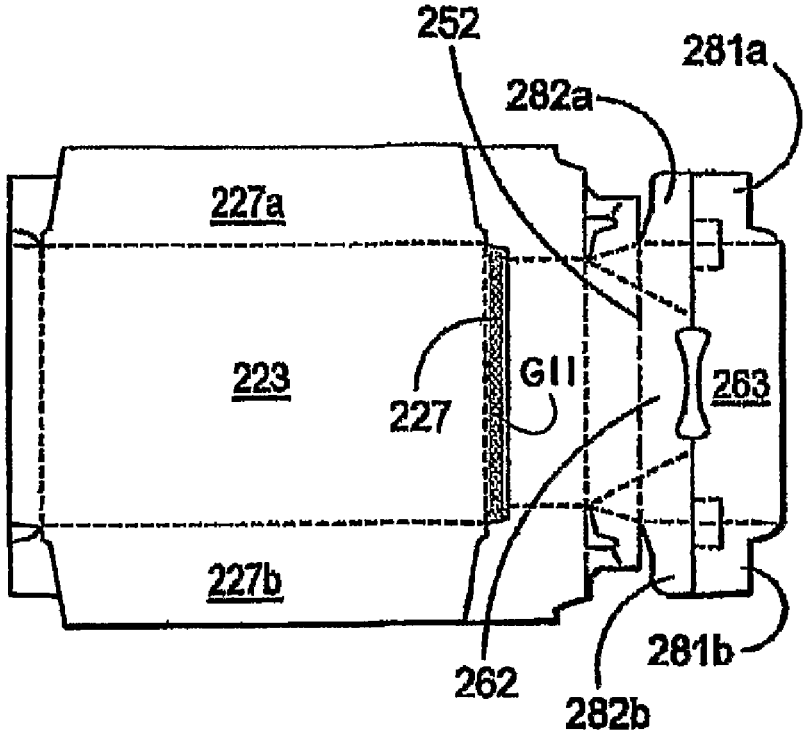
FIG. 19 is a plan view of the blank of FIG. 18, showing a second folding operation and emphasizing areas to which glue is applied.
Figure 20:
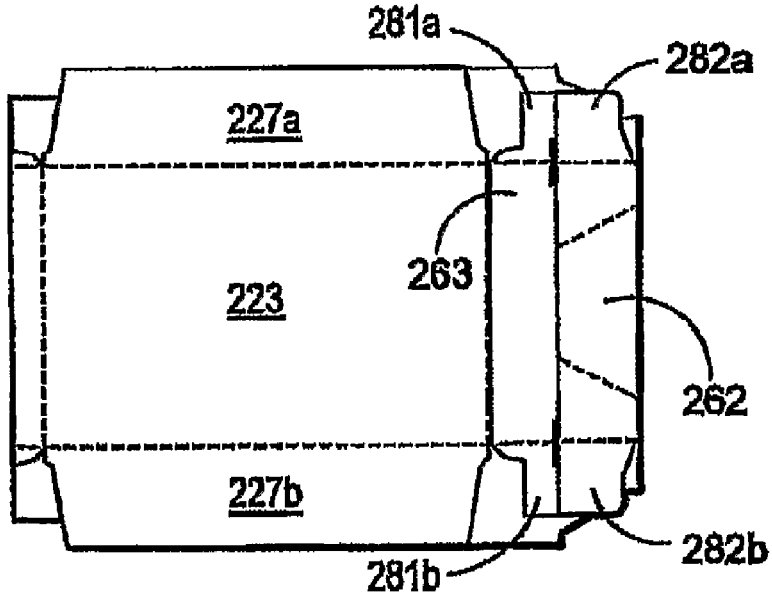
FIG. 20 is a plan view of the blank of FIG. 19, showing a third folding operation.

Composite handle panels 260/262, 264/266 and composite end flaps 282*a*/283*a*, 282*b*/283*b*, 284*a*/285*a*, 284*b*/285*b* are thereby formed. Referring to FIGS. 18 and 19, the blank 210 is folded about fold line 243 such that the inside surfaces of top and bottom panels 222, 223 are in flat face contact. Glue is applied to areas G11 the outside surface of edge flap 227. Referring to FIGS. 19 and 20, the blank 210 is folded about fold line 252 such that a portion of the inside surface of the outer handle panel 263 is in flat face contact with, and adhered to, the outside surface of the edge flap 227. The carton 230 is then erected, loaded, and closed by folding and securing the end flaps to form the end closure structures. As the end closure structures are formed, the composite end flaps 282*a*/283*a*, 282*b*/283*b*, 284*a*/285*a*, 284*b*/285*b* are folded and secured.

Figure 21:
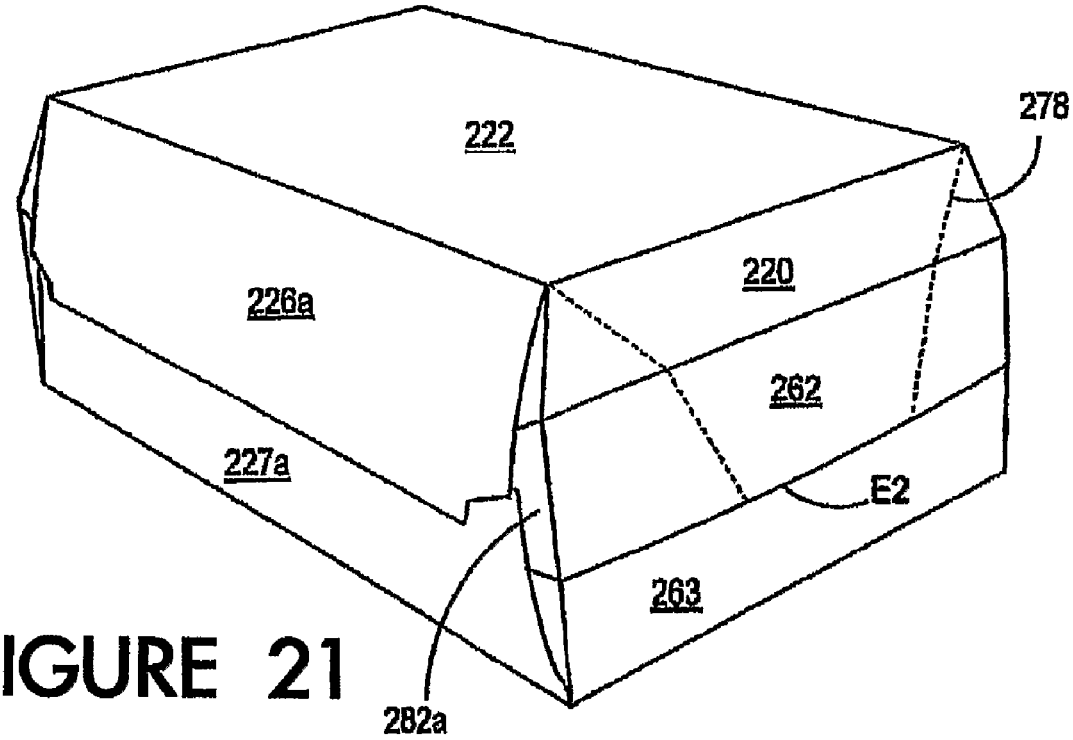
FIG. 21 is a perspective view of a carton, the carton being formed from the blank of FIG. 16.
Figure 22:
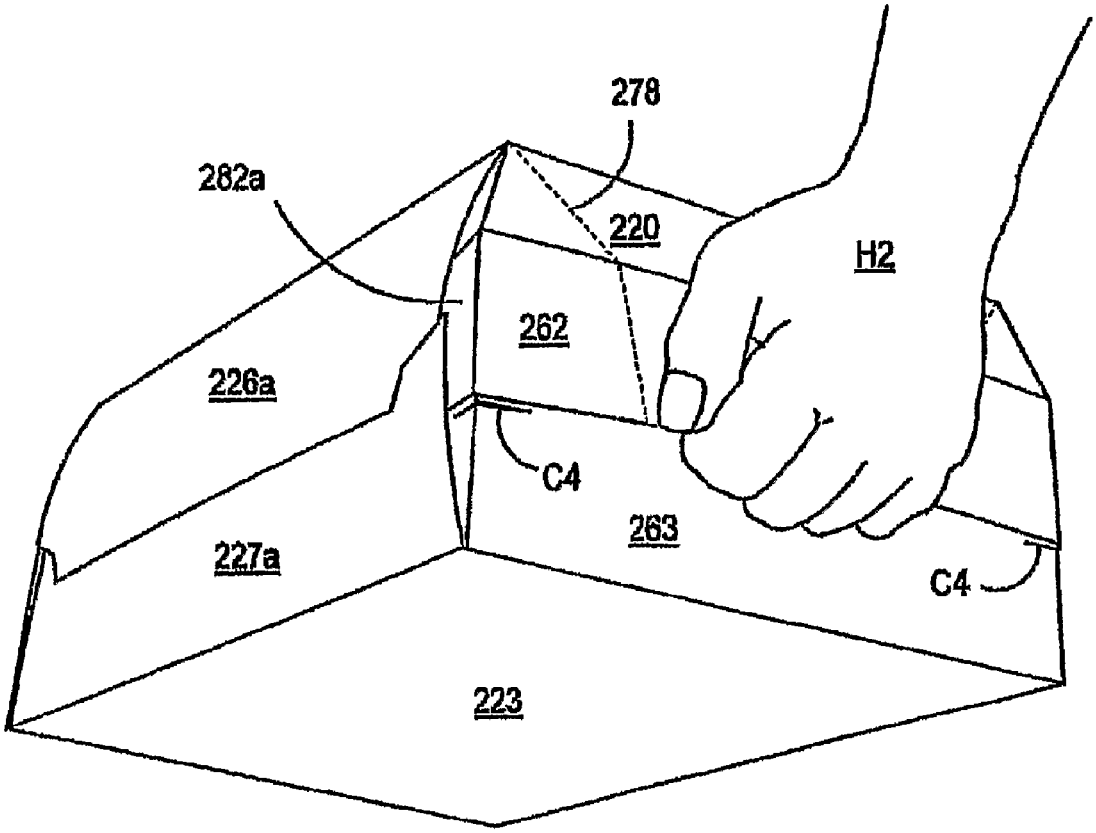
FIG. 22 is a perspective view of the carton of FIG. 21, the carton including handle structures that are engaged by a user's hands.

The completed carton 230, including handle structures, is illustrated in FIG. 21 and engagement of a handle structure is shown in FIG. 22. The user's fingers are inserted in a pocket between the side panel 263 and the composite handle panel 260/262. As described herein, the fold lines 278 allow the outer handle panel 262 and side panel 220 to flex outward and the cuts C4 allow the ends of the handle structure to displace inwardly as the handle structure is engaged.

Each handle flap F has been folded along fold lines 273, 275 to provide an aperture. In the erected carton 230, the aperture is provided in a pocket between a composite handle panel 260/262, 264/266 and a side panel 263, 267. The aperture allows the user's fingers to protrude into the carton 230, thereby counteracting the shallowness of the pocket.

Figure 23:
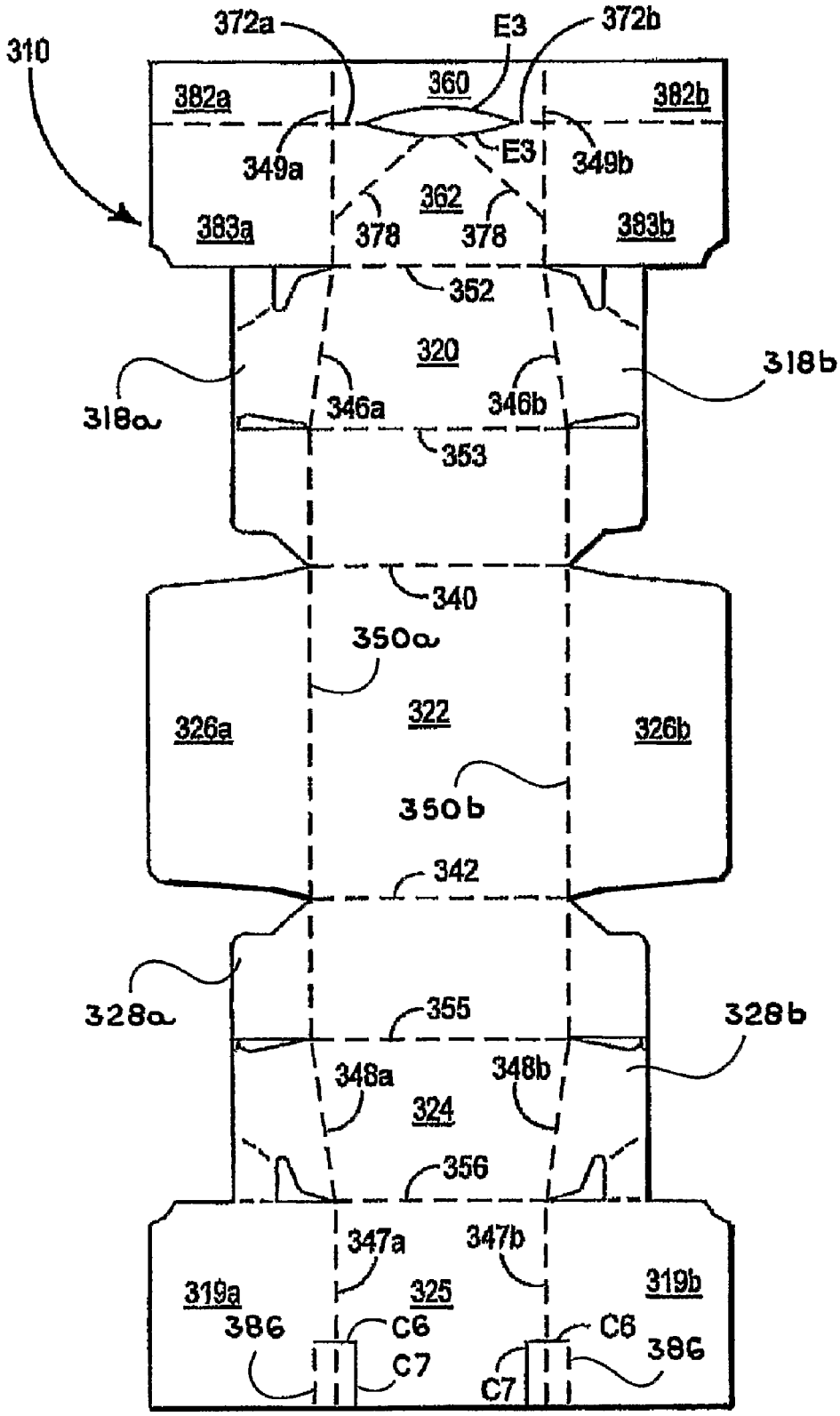
FIG. 23 is a plan view of a blank for forming a carton, according to a fourth embodiment of the present invention.

A fourth embodiment of the present invention is illustrated in FIGS. 23-28. FIG. 23 shows an elongate unitary blank 310 that can be used to form the carton 330 (shown in FIGS. 27 and 28). The blank 310 includes a series of primary panels that are hingedly connected, one to the next. The primary panels include a first side panel 320, a bottom panel 322, a second side panel 324, and a top panel 325. The primary panels are hingedly connected along fold lines 340, 342, 356. The side panels 320, 324 include fold lines 353, 355. The blank 310 includes end flaps 318*a*, 318*b*, 326*a*, 326*b*, 328*a*, 328*b*, 319*a*, 319*b* that are hingedly connected to opposing ends of the primary panels 320, 322, 324, 325 along fold lines 346*a*, 346*b*, 350*a*, 350*b*, 348*a*, 348*b*, 347*a*, 347*b*. The end flaps 318*a*, 318*b*, 326*a*, 326*b*, 328*a*, 328*b*, 319*a*, 319*b* are provided to form the end closure structures of the carton 330.

The blank 310 further includes handle panels and handle end flaps for forming a handle structure. The blank 310 includes an inner handle panel 360 and an outer handle panel 362. The inner handle panel 360 is hingedly connected to the outer panel 362 along interrupted fold lines 372*a*, 372*b*. The fold lines 372*a*, 372*b* are interrupted by an aperture A that is defined by edges E3. The inner and outer handle panels 360, 362 are hingedly connected to handle end flaps 382*a*, 382*b*, 383*a*, 383*b* along fold lines 349*a*, 349*b*. The outer handle panel 362 includes fold lines 378, which extend from an edge E3 to the fold lines 349*a*, 349*b*.

The blank 310 includes relief mechanisms that are at least partially defined by cut lines C6, C7. Each relief mechanism is disposed in top panel 325 and an adjacent end flap 319*a*, 319*b*. The relief mechanisms facilitate folding multiple plies of material and allow deformation of the handle structure as described herein. The cut lines C6 are offset from, and substantially parallel to, a transverse end of top panel 325 and are substantially bisected by the fold lines 347*a*, 347*b*. The cut lines C7 are offset from, and substantially parallel to, the fold line 347 and disposed on the top panel 325. Fold lines 386 extend from an end of the cut lines C6 to an adjacent edge of the end panels 319*a*, 319*b* and are substantially parallel to the fold lines 347*a*, 347*b*.

Figure 24:
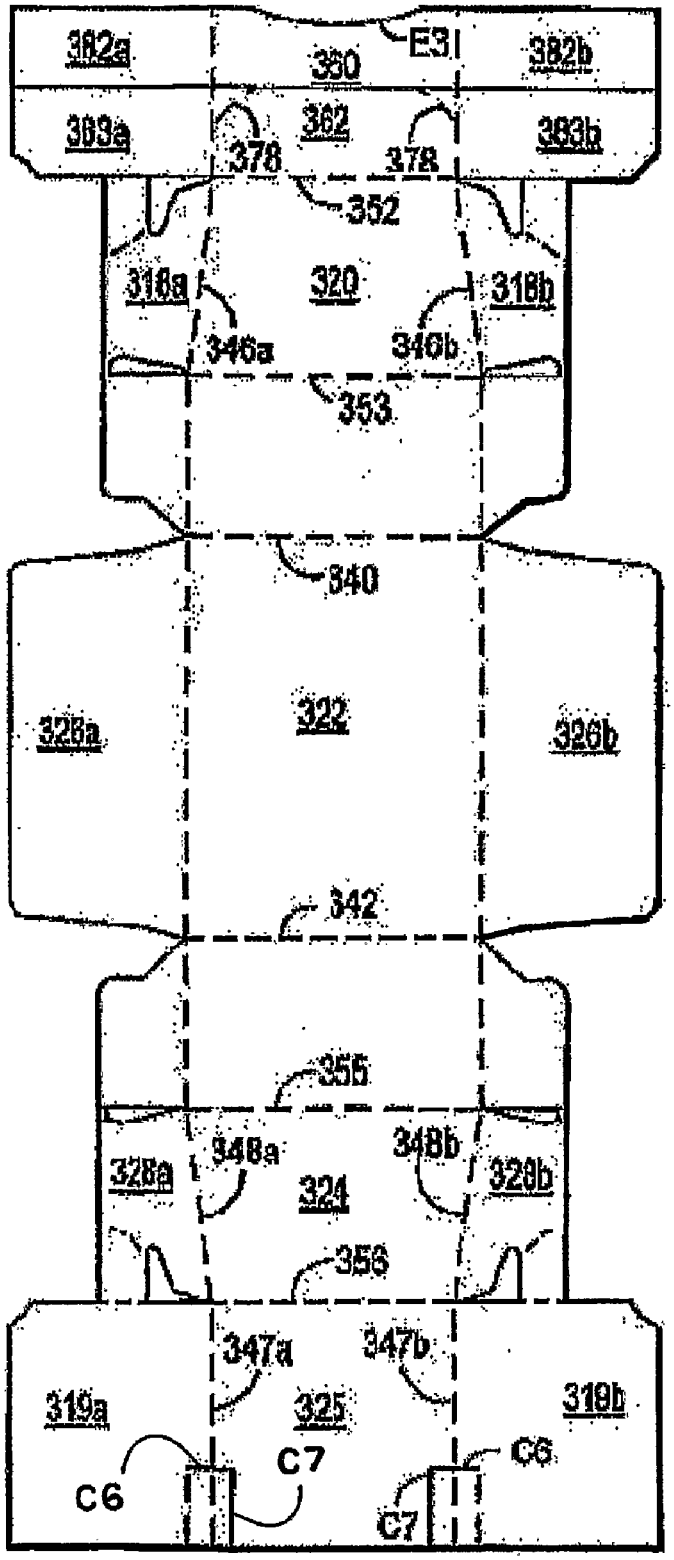
FIG. 24 is a plan view of the blank of FIG. 23, showing a first folding operation.
Figure 25:
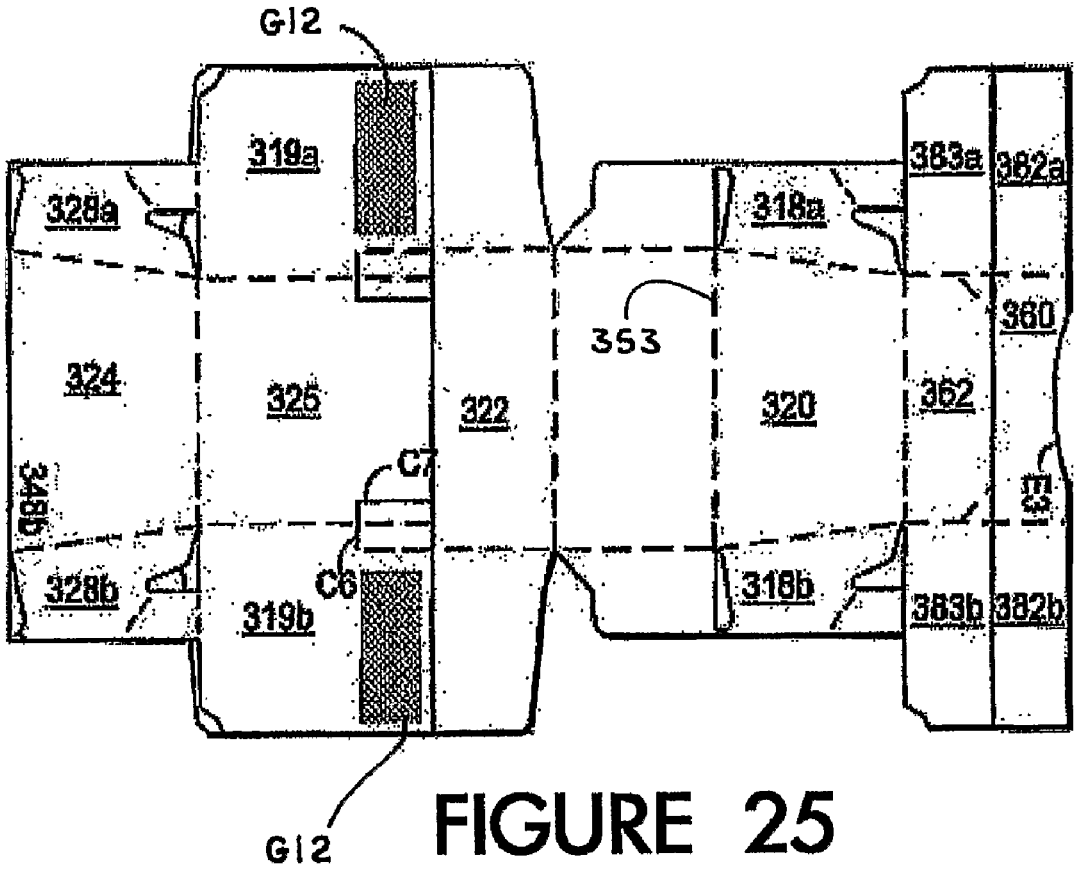
FIG. 25 is a plan view of the blank of FIG. 24, showing a second folding operation and emphasizing areas to which adhesive is applied.
Figure 26:
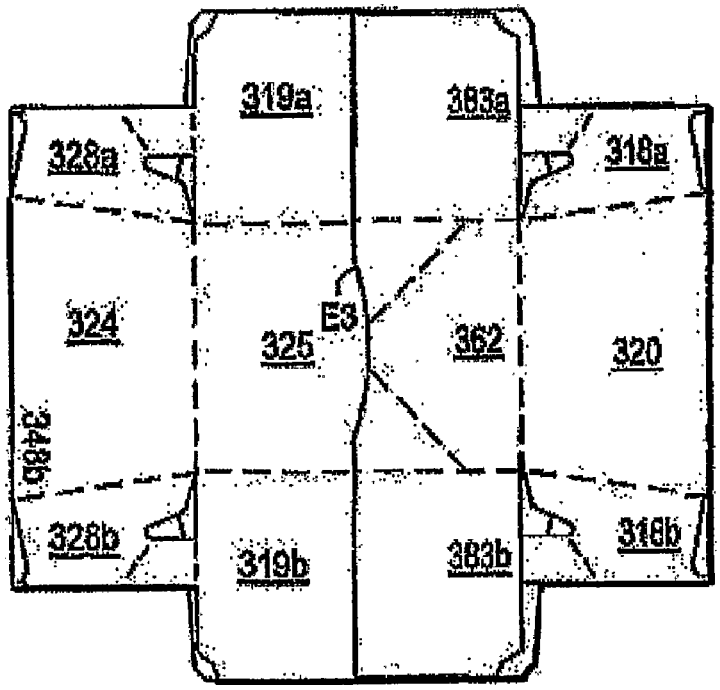
FIG. 26 is a plan view of the blank of FIG. 25, showing a third folding operation.
Figure 27:
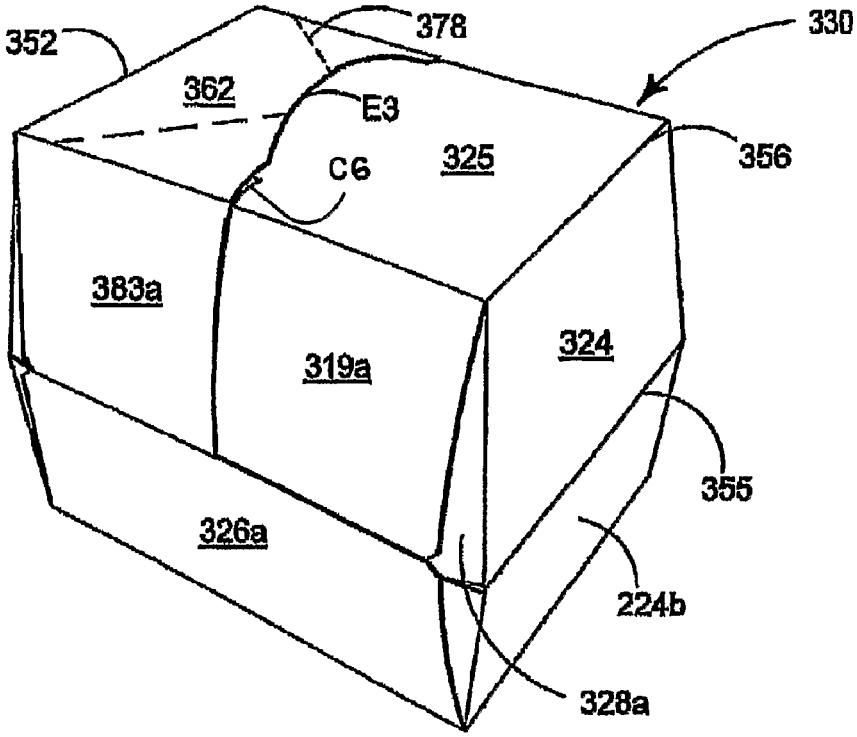
FIG. 27 shows a perspective view of a carton, the carton being formed from the blank of FIG. 23.
Figure 28:
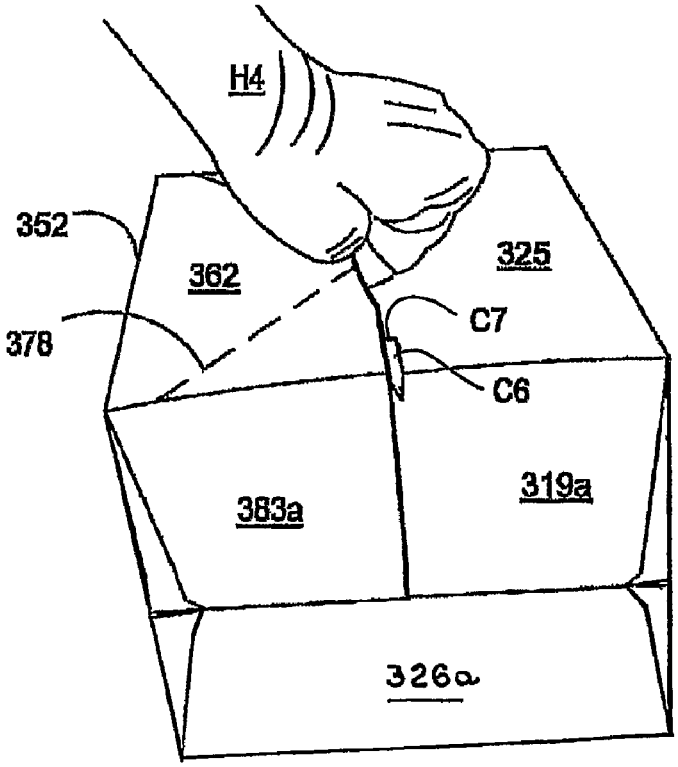
FIG. 28 is a perspective view of the carton of FIG. 27, the carton including a handle structure that is engaged by a hand.

A series of sequential folding and gluing steps are described as a non-limiting method of forming the carton 330 from the blank 310. The steps are illustrated in FIGS. 24-26. Referring to FIG. 24, the inner handle panel 360 and handle end flaps 382*a*, 382*b* are folded about fold lines 372*a*, 372*b* so that the inside surface of inner handle panel 360 lies in flat face contact with the inside surface of the outer handle panel 362. Subsequently, the inside surface of the handle end flap 382*a*, 382*b* is in flat face contact with the inside surface of the handle end flap 383*a*, 383*b*. The fold lines 372*a*, 372*b* and the edges E3 thereby define a transverse carrying edge. It is not necessary to adhere the inner and outer handle panels 360, 362 together or to adhere adjacent handle end flaps 382*a*, 382*b*, 383*a*, 383*b* together, although glue could be used to accomplish this if desired.

Referring to FIGS. 24 and 25, the side panel 324 is folded about fold line 355 so that the inside surface of top panel 325 lies in flat face contact with the inside surface of bottom panel 322. Glue G12 is then applied to the outer surface of the end flaps 319*a*, 319*b*. Referring to FIGS. 25 and 26, the first side panel 320 is folded about fold line 353 such that the outside surface of inside handle panel 360 is in flat face contact with the top panel 325 and the outside surface of the handle end flaps 382*a*, 382*b* are in flat face contact with the end flaps 319*a*, 319*b*. The handle end flaps 382*a*, 382*b* are thereby adhered to the end flaps 319*a*, 319*b* and disposed between the top end flaps 319*a*, 319*b* and handle end flaps 383*a*, 383*b*. The transverse carrying edge is substantially aligned with the cut lines C6. The folded carton blank 310 shown in FIG. 26 can then be erected into a tubular sleeve and loaded through one or both ends. Once loaded the end flaps 319*a*, 328*a*, 326*a*, 318*a*, 383*a*, 382*a* are folded and secured to form one end closure structure. Similarly, the end flaps 319*b*, 328*b*, 326*b*, 318*b*, 383*b*, 382*b*, are folded and secured to form another end closure structure of the carton 330. The handle end flaps 382*a*, 382*b*, 383*a*, 383*b* are folded and secured as the end closure structures are formed.

Once the carton 330 is fully erected, a pocket is formed between the top panel 325 and the handle structure as described herein. A user engages the pocket or handle structure as described herein. A hand H4 can be inserted into the pocket and the back of the hand H4 is substantially shielded from the carton contents. As the user's hand H4 is inserted into the carrying pocket, the weakened lines 378 can bow outwardly to provide more room between the top panel 325 and inner handle panel 360 to assist in the user's engagement of the pocket.

Similar to previous cut lines and relief mechanisms, the cut lines C6 and C7 allow the handle end flaps 382*a*, 383*a*, 382*b*, 383*b* and adjacent portions of the top end flaps 319*a*, 319*b* to displace inwardly. The cut lines C6, C7 also allow the handle panels 360, 362 to give inward or flex to provide a greater space between the inner and outer handle panels 360, 362 and the top panel 325.

In this embodiment, the inner handle panel 360 is dimensioned so that it provides reinforcement to the transverse carrying edge. However, it is envisaged that the inner handle panel 360 could be sized similarly to the outer handle panel 362 or indeed the inner handle panel 360 may not be required at all.

Figure 29:
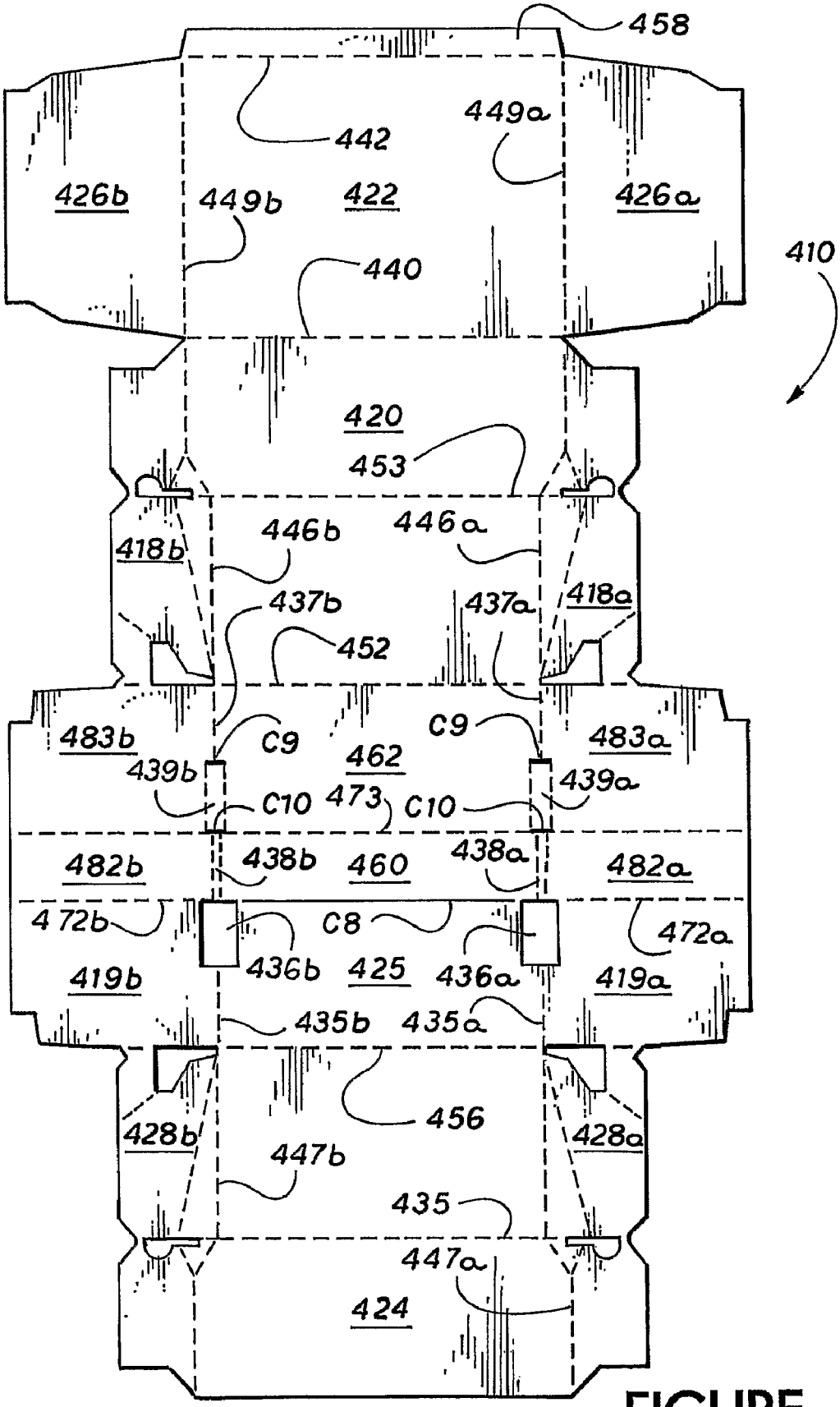
FIG. 29 is a plan view of a blank for forming a carton, according to a fifth embodiment of the invention.

A fifth embodiment of the present invention is illustrated in FIGS. 29-32. FIG. 29 shows an elongate unitary blank 410 from which a carton 430 (shown in FIG. 31) is formed. The blank 410 includes a series of primary panels and handle panels that are hingedly connected, one to the next, in series. The primary panels include a first side panel 420, a bottom panel 422, a second side panel 424, and a top panel 425. The handle panels include an inner handle panel 460 and an outer handle panel 462. The panels 422, 420, 462, 460, 425, 424 are hingedly connected along fold lines 440, 452, 473, 472*a*, 472*b*, 456. The first side panel 420 includes a fold line 453 and the second side panel 424 includes a fold line 455. A cut line C8 is disposed between the fold lines 472*a*, 472*b*, which at least partially separates the inner handle panel 460 and the top panel 425. An edge flap 458 is hingedly connected to the bottom panel 422 along a fold line 442.

A series of end flaps and handle end flaps are hingedly connected to the primary panels and the handle panels. More specifically, bottom end flaps 426*a*, 426*b* are hingedly connected to the bottom panel 422 along fold lines 449*a*, 449*b*, side end flaps 418*a*, 418*b* are hingedly connected to the first side panel 420 along fold lines 446*a*, 446*b*, and side flaps 428*a*, 428*b* are hingedly connected to the second side panels 424 along fold lines 447*a*, 447*b*.

Further, handle end flaps 483*a*, 483*b* are hingedly connected to the outer handle panel 462 at least partially along fold lines 437*a*, 437*b*, respectively. Additionally, deformable portions 439*a*, 439*b* are disposed along the hinged connection between the outer handle panel 462 and end flaps 483*a*, 483*b*, respectively. The deformable portions 439*a*, 439*b* are further defined by cuts C9, C10 that facilitate folding multiple plies of material. Similarly, deformable portions 438*a*, 438*b* are disposed between, and hingedly connected to, inner handle panel 460 and end flaps 482*a*, 482*b*, respectively. Deformable portions 438*a*, 438*b* are relatively narrower than deformable portions 439*a*, 439*b*. Top end flaps 419*a*, 419*b* are hingedly connected to the top panel 425 along fold lines 435*a*, 435*b*. The fold lines 435*a*, 435*b* are interrupted by an aperture 436*a*, 436*b* that is disposed between the top panel 425 and the top end flaps 419*a*, 419*b*. The apertures 436*a*, 436*b* act as a relief mechanism as described herein.

A series of sequential folding and gluing stages are now described as a non-limiting method for forming the carton 430 from the blank 410. Glue (not shown) is applied to the inside surface of outer handle panel 462 and to the inside surface of the handle end flaps 483*a*, 483*b*. The inner handle panel 460 and handle end flaps 482*a*, 482*b* are then folded about fold line 473 so that the inside face of the inner handle panel 460 lies in flat face contact with, and is secured to, the inside face of the outer handle panel 462 thereby forming a composite handle panel 460/462. The composite handle panel 460/462 includes a transverse carrying edge defined by fold line 473. Similarly, the inside face of the end flaps 482*a*, 482*b* lie in flat face contact with, and are respectively secured to, the inside face of the end flaps 483*a*, 483*b* thereby forming composite handle end flaps 482*a*/483*a*, 482*b*/483*b*. The deformable portions 438*a*, 438*b* subsequently align with, and are in a face contacting relationship with, the deformable portions 439*a*, 439*b*. It should be noted that the glue is applied such that the deformable portions 438*a*, 438*b*, 439*a*, 439*b* are not secured together or to an adjacent panel or end flap. The deformable portions 438*a*, 438*b* are overlapped by the deformable portions 439*a*, 439*b*, respectively.

Figure 30:
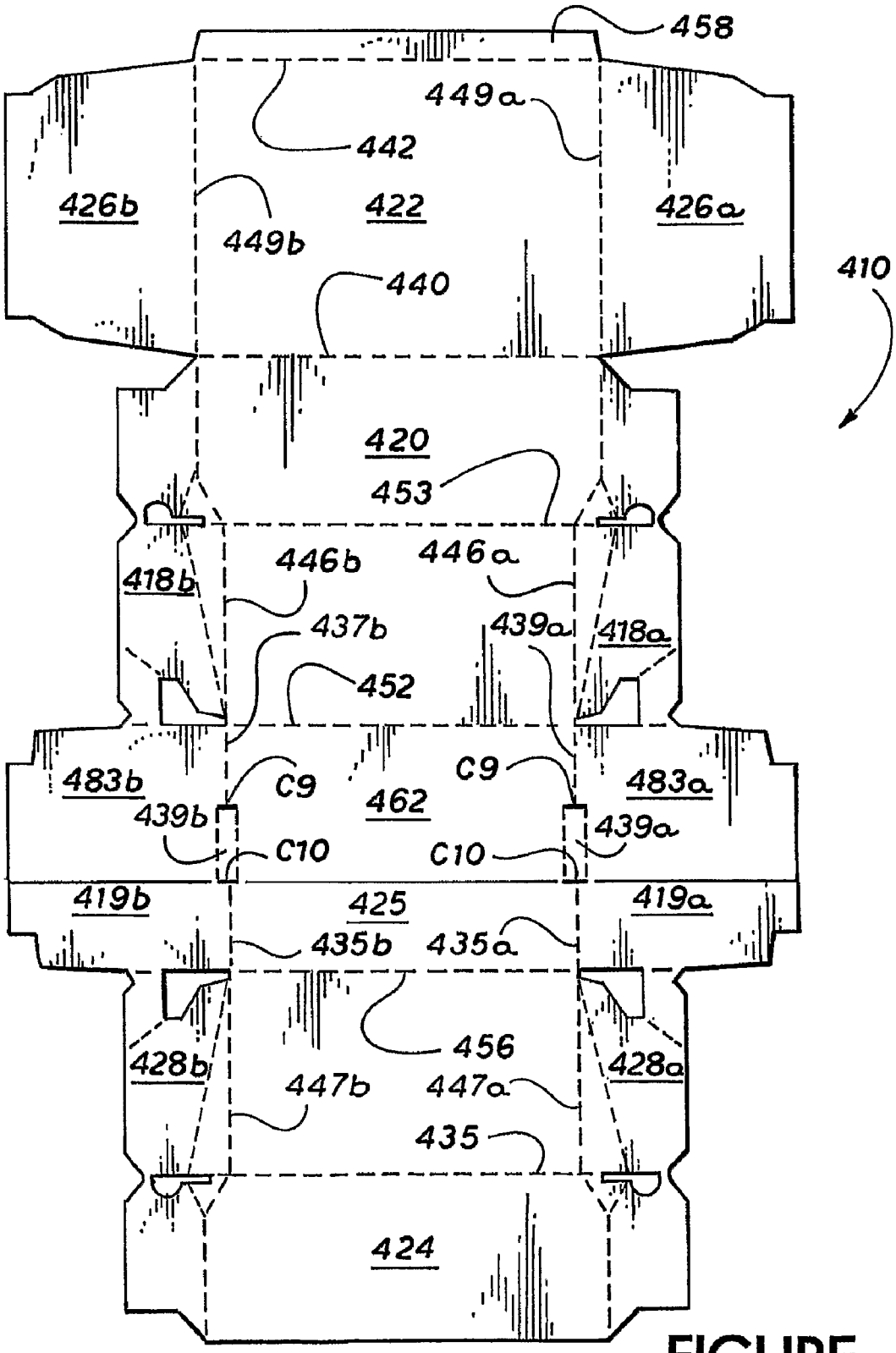
FIG. 30 is a plan view of the blank of FIG. 29, showing a first folding operation.
Figure 31:
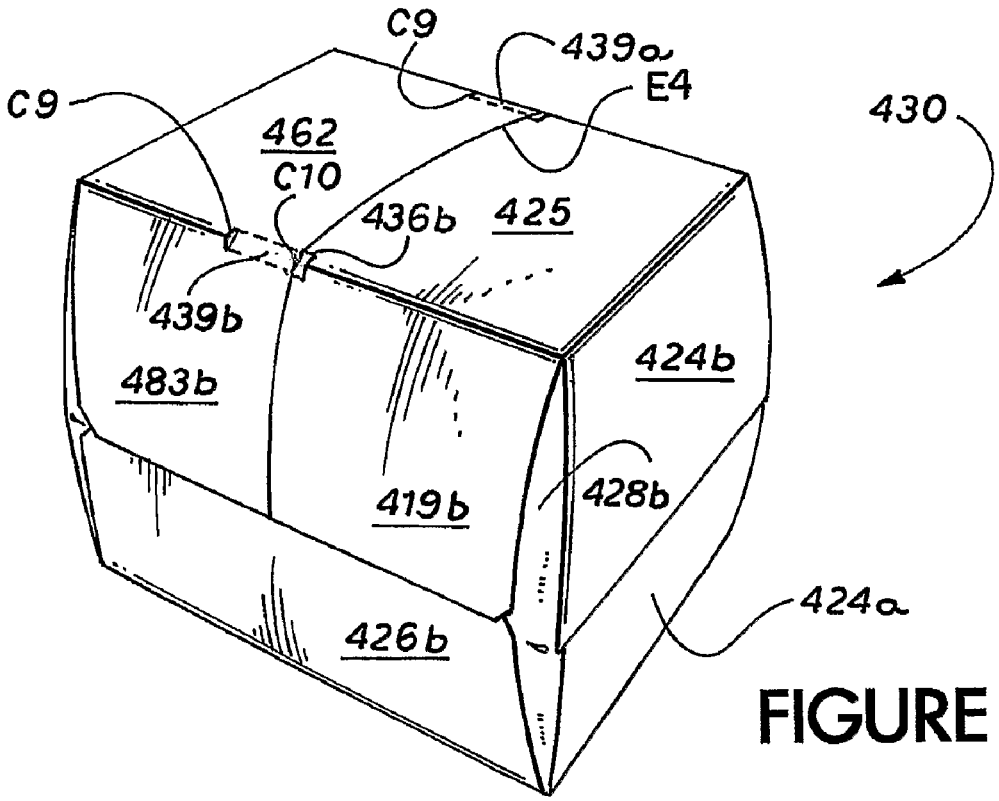
FIG. 31 is a perspective view of a carton, the carton being formed from the blank of FIG. 29.

Glue (not shown) is applied to a portion of the outside surface of the top end flaps 419*a*, 419*b*. The inner handle panel 460 and end flaps 482*a*, 482*b* are then folded about fold lines 472*a*, 472*b* so that the outside face of the inner handle panel 460 lies in flat face contact with the outside face of the top panel 425 and the outside face of the end flaps 482*a*, 482*b* lie in flat face contact with, and are secured to, top end flaps 419*a*, 419*b*. The deformable portions 438*a*, 438*b*, 439*a*, 439*b* subsequently align with the apertures 436*a*, 436*b*. The transverse carrying edge substantially aligns with a edge of the apertures 436*a*, 436*b*. The partially folded blank 410 is illustrated in FIG. 30.

The partially folded blank 410 can then be erected into a tubular sleeve, which can be loaded through one or both ends. The tubular sleeve is formed by securing the outside surface of the edge flap 458 to the inside surface of the second side panel 424. Once loaded, the end flaps 426*a*, 418*a*, 483*a*, 482*a*, 419*a*, 428*a* are folded and secured to form an end closure structure. Similarly, the end flaps 426*b*, 418*b*, 483*b*, 482*b*, 419*b*, 428*b* are folded and secured to form another end closure structure. The deformable portions 438*a*, 438*b*, 439*a*, 439*b* and the apertures 436*a*, 436*b* facilitate folding overlapping end flaps 483*a*/482*a*/419*a*, 483*b*/482*b*/419*b*. More specifically, folding is facilitated at a corner involving two or more plies where the amount of material at the corner decreases from the outside ply to the inside ply. Thereby, the narrower deformable portions 438*a*, 438*b* are overlapped by the wider deformable portions 439*a*, 439*b* to facilitate folding.

Once the carton 430 is erected, a pocket is formed between the top panel 425 and the composite handle panel 460/462. The composite handle end flaps 482*a*/483*a*, 482*b*/483*b*, which are folded and secured as described above, secure the end portions of the composite handle panel 460/462 and define the pocket. Alternatively, the end portion of the composite handle panel 460/462 can be at least partially secured to the top panel 425 by applying glue (not shown) to areas on to each end portion of the composite handle panel 460/462 and folding the blank 410 such that the composite handle panel 460/462 is in flat face contact with the top panel 425. Thereby, access into the pocket is provided along the traverse carrying edge of the composite handle panel 460/462.

Figure 32:
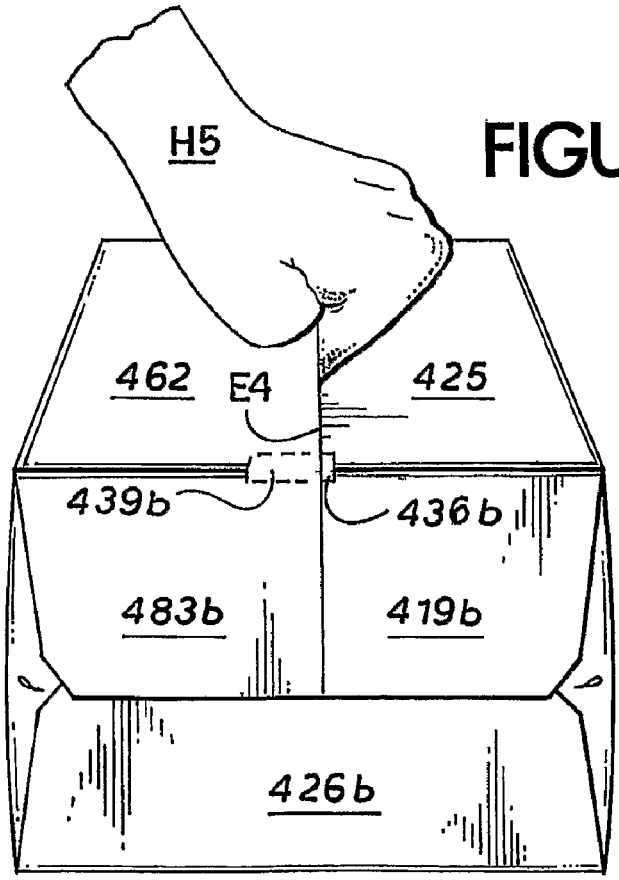
FIG. 32 is a perspective view of the carton of FIG. 31, the carton including a handle structure that is engaged by a user's hand.

Engagement of the carrying handle is shown in FIG. 32. A user engages the handle structure as described herein. The fingers of a user's hand H5 can be inserted into the pocket, between the top panel 425 and the composite handle panel 460/462. The hand H5 can be inserted through the bottom of the pocket and inside the carton through a slot formed by the cut line C8. As the fingers of a user's hand H5 are inserted into the pocket, the composite handle panel 460/462 is displaced from the top panel 425, or otherwise the handle structure flexes, causing the end portions of the handle panel 460/462 to displace inwardly. The inward displacement of the end portions of the handle panel 460/462 is facilitated by the deformable portions 438*a*, 438*b*, 439*a*, 439*b* and the apertures 436*a*, 436*b*. The cut lines C9, C10 allow the deformable portions 438*a*, 438*b*, 439*a*, 439*b* to deform or move. As the end portions of the handle panel 460/462 move inwardly, the deformable portions 438*a*, 438*b*, 439*a*, 439*b* move inwardly toward the apertures 436*a*, 436*b*. Since the apertures 436*a*, 436*b* are located at corners of the carton 430, the deformable portions 438*a*, 438*b*, 439*a*, 439*b* are substantially unobstructed and the composite panel 460/462 has increased flexibility.

It can be appreciated that various changes may be made without departing from the scope of the present invention. For example, the size and shape of the carton panels may be adjusted to accommodate articles of differing size or shape. The handle structure may be shaped according to a variety of user requirements. The use of glue or adhesive means for securing the carton walls may vary between carton constructions. Handle panels may be sized according to the desired pocket style. It is also envisaged that the inner handle panel could be omitted from the handle structure completely. Furthermore, it is envisaged that different arrangements of weakened lines and cut lines could be used to provide the relief mechanism at the ends of the pocket handle. It will also be apparent that the pocket handle of the present invention could be applied to a variety of cartons and its application is not limited to only the specific carton structures disclosed. It is also clear that the carton and handle structure can be made from a unitary blank, two-part blank, or can be formed from material not initially integral with the blank.

It will also be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a score line, a frangible line or a fold line without departing from the scope of the invention.

The above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A carton for packaging articles, comprising a plurality of panels arranged to form walls of said carton and at least one handle structure, said at least one handle structure comprising a pair of inner and outer handle panels hingedly connected together along a fold line, said inner and outer handle panels being disposed in an overlapping relationship, each of said inner and outer handle panels having a transverse edge at a position opposite to said fold line, said inner handle panel being disposed in an overlapping relationship with a first one of said plurality of panels, said outer handle panel being disposed adjacent to a second one of said plurality of panels, wherein one of said transverse edges is connected to one of said first and second ones of said plurality of panels, and said fold line defines a carrying edge of said at least one handle structure, said at least one handle structure further comprising a pair of integral end portions secured to third and fourth ones of said plurality of panels respectively so as to close opposite ends of a pocket formed between said inner handle panel and said first one of said plurality of panels, wherein an opening of said pocket is disposed adjacent to said carrying edge so that said carrying edge can be engaged to carry the carton.

2. The carton of claim 1, wherein said handle structure is arranged such that upon lifting the carton, the load of the carton is in part transferred to said one of said transverse edges.

3. The carton of claim 1, wherein said said third and fourth ones of said plurality of panels provide end walls of the carton respectively, said end walls being disposed adjacent to said first one of said plurality of panels.

4. The carton of claim 3, wherein each of said end portions comprising at least one handle end flap hingedly connected to at least one of said inner and outer handle panels.

5. The carton of claim 3, wherein said each of said end portions provides at least a portion of a respective one of said end walls.

6. The carton of claim 1, wherein said inner handle panel is hingedly connected to said first one of said plurality of panels along said transverse edge of said inner handle panel.

7. The carton of claim 6 wherein said outer handle panel is hingedly connected to said second one of said plurality of panels along said transverse edge of said outer handle panel.

8. The carton of claim 7, wherein said transverse edge of said inner handle panel is offset from said transverse edge of the outer handle panel.

9. The carton of claim 1, wherein said outer handler panel is hingedly connected to said second one of said plurality of panels alone said transverse edge of said outer handle panel.

10. The carton of claim 1. said inner handle panel is disposed between the outer handle panel and the first one of said plurality of panels.

11. The carton of claim 1, wherein at least one corner of said carton comprises a relief mechanism, said at least one corner being defined by said outer handle panel and at least one of said end portions, and wherein the relief mechanism facilitates flexing of said handle structure as the pocket is opened and the carton is lifted.

12. The carton of claim 11, wherein said relief mechanism comprises one or more cut lines disposed at least in part in said first one of said plurality of panels proximate a corner configuration of the outer handle panel and an end portion.

13. The carton of claim 12, said relief mechanism comprises a cut line extending in said first one of said plurality of panels and an adjacent panel, the cut line being disposed proximate said corner.

14. An elongate blank for forming a carton for enclosing article comprising a plurality of panels hingedly connected together in series for forming walls of the carton and a pair of first and second handle panels and integral end portions for forming a handle structure for carrying the carton, said first and second handle panels being hingedly connected together alone a fold line, each of said first and second handle panels having a transverse edge at a position opposite to said fold line said first and second handle panels and said integral end portions being foldable and securable into an arrangement wherein one of said first and second handle panels is connected along said transverse edge thereof to a first one of said plurality of panels, said fold line, providing a carrying edge of said handle structure when the blank is set up into a carton, and said first and second handle panels being disposed in overlapping relationship with each other when the blank is set up into a carton, said one of said first and second handle panels being disposed in overlapping relationship with said first one of said plurality of panels when the blank is set up into a carton, wherein the integral end portions are securable in a corner configuration relative to said first one of said plurality of panels such that a pocket is formable between said one of said first and second handle panels and said first one of said plurality of panels when the blank is set up into a carton.

15. The blank of claim 14, further comprising deformable portions that are disposed along a hinged connection between said one of said first and second handle panels and said end portions, the deformable portions being hinged to opposing ends of the first one of said plurality of panels.

16. The blank of claim 15, wherein each of said deformable portions is defined by at least one of a fold line and a severance line.

17. The blank of claim 14, wherein said first and second handle panels comprises an inner handle panel and an outer handle panel respectively when the blank is set up into a carton, said outer handle panel being hingedly connected along said transverse edge thereof to said first one of said plurality of panels.

18. The blank of claim 14, wherein each of said end portions comprises at least one handle end flap hingedly connected to one of said first and second handle panels.

19. The blank of claim 14 wherein at least one of said first and second handle panels comprise fold lines for facilitating flexing of the handle structure when formed.

* * * * *